United States Patent [19]

Holder

[11] Patent Number: 4,869,324

[45] Date of Patent: Sep. 26, 1989

[54] INFLATABLE PACKERS AND METHODS OF UTILIZATION

[75] Inventor: Danny J. Holder, Spring, Tex.

[73] Assignee: Baker Hughes Incorporated, Houston, Tex.

[21] Appl. No.: 170,990

[22] Filed: Mar. 21, 1988

[51] Int. Cl.[4] ..... E21B 33/122

[52] U.S. Cl. ..... 166/387; 166/123; 166/187; 166/191; 166/250; 277/34.3

[58] Field of Search ..... 166/123, 124, 125, 187, 166/182, 186, 187, 191, 250, 373, 374, 387; 277/34, 34.3, 34.6

[56] References Cited

U.S. PATENT DOCUMENTS

| | | | |
|---|---|---|---|
| 3,876,003 | 4/1975 | Kisling | 166/187 X |
| 4,320,800 | 3/1982 | Upchuch | 166/187 X |
| 4,580,632 | 4/1986 | Reardon | 166/250 |
| 4,708,208 | 11/1987 | Halbardier | 166/387 |

*Primary Examiner*—William P. Neuder

*Attorney, Agent, or Firm*—Hubbard, Thurman, Turner & Tucker

[57] ABSTRACT

Modifications are provided for both single unit and dual unit inflatable packers or bridge plugs permitting such inflatable tools to be inserted in a well through the primary tubing string which in turn is suitably sealably anchored in the well above the producing formations. The inflatable tool is inserted into the well on a conduit, such as coiled tubing, and fluid pressure transmitted through the conduit is utilized to effect the expansion and setting of the inflatable elements of the inflatable tool. The conduit is connected to the inflatable tool by a fluid pressure operated release mechanism and, following the inflation of the inflatable element or elements, the conduit may be utilized to supply treatment fluid or cementing fluid to a formation isolated by the inflatable tool. Alternatively, the conduit may be disconnected from the inflatable tool and retrieved from the well to permit the inflated tool to maintain a production formation in an isolated condition, to prevent further leakage of a leaking packer, or to permit wireline installation of a choke to regulate the amount of flow into or out of a producing or injection formation isolated by the inflated tool.

26 Claims, 13 Drawing Sheets

INFLATABLE PACKERS AND METHODS OF UTILIZATION

RELATIONSHIP TO OTHER PENDING APPLICATIONS

This application relates to subject matter similar to that of pending applications, Ser. No. 877,421, filed, June 23, 1986, Ser. No. 113,172, filed 10/23/87, and Ser. No. 112,888, filed 10/23/87, all of such applications being assigned to the assignee of this application.

BACKGROUND OF THE INVENTION

1. Field of the Invention

The present invention relates to methods and apparatus for setting and unsetting an inflatable packer or bridge plug in a subterranean oil or gas well by using coiled tubing or remedial tubing for pumping fluids to the packer or bridge plug. More particularly, the invention relates to improved methods and apparatus for utilizing an inflatable packer for treatment, cementing or flow control operations on a producing well or an injection well without requiring the removal of the primary tubing string from the well, or killing of the well.

2. Description of the Prior Art

Those skilled in the art relating to remedial operations associated with the production and treatment of subterranean oil and gas wells have long utilized threaded or coupled remedial tubing inserted through production tubing for pumping fluids from the surface to one or more inflatable packers disposed downhole adjacent production formations. More recently, continuous coiled tubing has generally replaced threaded or coupled tubing in such applications, since coiled tubing may be more rapidly inserted into the well and may be easily passed through production tubing and related downhole equipment because its diameter is consistently the same size.

Typical remedial coiled tubing apparatus is described in the 1973 Composite Catalogue of Oil Field Equipment and Services, at page 662 (GULF PUBLISHING CO., Houston, Tex.), and manufactured by Bowen Tools, Inc. of Houston, Tex. Apparatus relating to the coiled tubing technique is more particularly described in U.S. Pat. Nos: 3,182,877 and 3,614,019. The need frequently arises in remedial or stimulation operations to pass an inflatable packer or bridge plug through small diameter restrictions, e.g. three and a half inch tubing string, and set the packer or bridge plug in a relatively large diameter casing, e.g., seven inch casing, to accomplish remedial or stimulation operations. The packer or bridge plug is then deflated and retrieved to the surface through the tubing string. Recent advances, such as those disclosed in U.S. Pat. No. 4,349,204, enable inflatable packers or bridge plugs to pass through such relatively small diameter tubing string, effectively seal with a larger diameter casing, and then be retrievable to the surface through the tubing string.

The above referred to co-pending applications, each of which is hereby incorporated by reference in this application, deal with the problem of effecting a fluid pressure actuated disconnection of the coiled tubing from the inflatable packer or bridge plug. The tensile strength of such coiled tubing is very small and, during the retrieval of the inflatable packer or bridge plug, a hang-up can occur which cannot be dislodged by tensile forces exerted on the coiled tubing. It is of course understood that rotation of the coiled tubing is a practical impossibility. To solve this problem, the first filed of the above identified copending applications, discloses a fluid pressure actuated disconnecting mechanism for incorporation in a run-in tool which is conventionally secured to the bottom end of coiled tubing by set screws, or any other conventional means, and is detachably engagable with the top end of an inflatable packer by a fluid pressure actuated release mechanism. The application of a fluid pressure through the coiled tubing to the fluid pressure actuated release mechanism at a predetermined pressure level effects the release of the run-in tool from the inflatable packer, permitting the coiled tubing to be removed and subsequent operations on the inflatable packer performed by wireline.

Additionally, in the first filed application, Ser. No. 877,421, the fluid pressure to effect the inflation of a packer is derived by dropping or pumping a ball through the coiled tubing which seats on a valve seat sleeve which is shearably secured in the bore of an inflatable packer. After inflation of the inflatable element of the inflatable packer has been accomplished, an increase in fluid pressure supplied by the coiled tubing will effect the shearing of the securement of the ball seat sleeve and permit the ball and the seat sleeve to be forced downwardly out of the packer bore, thus opening the bore of the packer so that treatment fluid can be supplied through the coiled tubing to the isolated portion of the well below the packer. When the treatment operation is completed, and it is desired to remove the inflatable packer from the well, a second ball is dropped or pumped which engages a second valve seat sleeve shearably secured in the bore of the inflatable packer. The valve seat sleeve cooperates with two axially spaced seals to effect a bridging connection across radial ports provided in the wall of the tubular packer. Thus, an increase in fluid pressure applied to the second ball valve will effect the downward movement of the second ball valve seat and will open the radial ports to equalize the fluid pressures above and below the inflatable element of the inflatable packer.

A third, still larger ball valve seat is provided in the upper portions of the inflatable packer to receive a third ball and this ball permits the fluid pressure applied through the coiled tubing to be increased to a level which will effect the disengagement of the fluid pressure actuated release mechanism carried by the run-in tool. Normally, the fluid pressure actuated release mechanism is not employed unless an obstruction is encountered during retrieval of the inflatable packer.

The disclosure of the above referred to co-pending application, Ser. No. 113,172, filed 10/23/87 differs from that of the first filed copending application in that inflatable bottom is a bridge plug and the bottom end of the inflatable tool mounts an axially shiftable plug valve having a sleeve portion which is normally positioned to permit circulation of fluid through ports in the wall of such sleeve portion during run-in. The sleeve valve incorporates a ball seating surface and the first mentioned ball is dropped to seat on such surface. The application of fluid pressure through the coiled tubing effects an axial shifting of the cylindrical valve plug to close the circulation ports after run-in.

Experimentation with the inflatable packer or bridge plug mechanisms described in the first two of the above referred to co-pending applications has revealed many potential applications for such mechanisms. At the same time, some applications involve the disconnection of the coiled tubing from the inflatable packer and the retrieval of the coiled tubing from the well while the inflatable packer or bridge plug remains in an inflated, set condition in the well. Under these circumstances, it is necessary to provide an alternate mechanism for effecting the fluid pressure equalization above and below the inflated element of the inflatable packer prior or bridge plug to effecting the deflation of such inflated tool. The incorporation of a wireline operated pressure equalization mandrel in the inflatable tool is disclosed in the third co-pending application, Ser. No. 112,888 filed 10/23/87.

Other applications of the inflatable packer mechanism described in the above referred to co-pending applications have required that the bore of the inflatable packer remain free of any ball or valve obstruction after the coiled tubing is disconnected from the inflated packer. Still other applications require the incorporation of a plurality of axially spaced, inflatable packing elements on a single packer or bridge plug.

SUMMARY OF THE INVENTION

As used herein, the term "inflatable tool" is used to describe either a packer or bridge plug having at least one inflatable packing element. The overcoming of the above mentioned structural deficiencies of inflatable tools described in the aforementioned co-pending applications constitutes one object of this invention. The provision of new methods of utilization of inflatable tools of the type described in the above mentioned co-pending applications and the additional designs of inflatable tools herein described, in a variety of well treatment and flow regulation operations, constitute further objects of this invention.

To effect the disconnection of the run-in tool by actuation of the fluid pressure actuated release mechanism without leaving a ball within the bore of the inflated tool, this invention provides an upwardly facing ball seat in the lower extremities of the run-in tool at a position below the radial ports which effect communication between the bore of the coiled tubing and the piston which actuates the release mechanism. Such piston can then be shifted by fluid pressure in the coiled tubing to a position releasing the connecting mechanism and permitting the run-in tool and coiled tubing to be removed from the well without leaving any ball valve within the bore of the inflated tool.

For those applications of inflatable tools requiring a plurality of axially spaced, inflatable packing elements, this invention provides a single inflation passage to all of the inflatable packing elements controlled by a single check valve. Deflation of all inflatable packing elements is accomplished simultaneously by moving seal bypassing grooves concurrently to open the top and bottom ends of the inflation passage to vent into the casing annulus.

By utilizing one or both of the above mentioned design modifications, the utility of an inflatable tool, having either a single or an axially spaced pair of inflatable elements can be substantially increased. In accordance with this invention, an inflatable tool incorporating a single inflatable element can be mounted on a small diameter conduit, such as coiled tubing, and run into a producing or injection well through the primary tubing string and packer, if one is used, to a position adjacent a production or injection formation. If the inflatable tool incorporates the above mentioned plug valve converting the inflatable tool into a bridge plug, the setting of the inflatable bridge plug below a selected formation or formations, permits treatment fluid to be supplied through the primary tubing string directly to only the selected formation, without requiring that the well be killed. Thus, washing, acidizing and squeezing or other remedial operations can be performed directly on the isolated formation by pressured fluid supplied through the tubing string.

At the conclusion of the treatment operation, the coiled tubing and run-in tool can be retrieved from the well and a wireline tool run into the well to first engage and retrieve a pressure equalizing mandrel from the inflatable tool, thus equalizing fluid pressures above and below the inflated elements of the bridge plug. A second trip of a wireline tool is then made to engage a fishing neck provided on the tubular body of the inflatable tool so effect an upward movement of such body which brings venting grooves on the exterior of the tubular body into communication with the interior of the inflatable element(s) on the tool, thus accomplishing the deflation of the inflated tool and permitting retrieval of the deflated tool from the well.

If the production or injection formation to be treated lies below other formations, then the inflatable packer version having an open bore through the tool is employed. Pressurized treatment fluid can then be supplied through the coiled tubing directly to the lower formation to be treated.

An inflatable tool having a single inflatable packing element may be employed to regulate the quantity of fluid flowing into or out of a selected formation. Here again the open bore, packer version of the inflatable tool is employed and the deflated packer is run through the primary tubing string and packer, if one is used, and then inflated to engage the casing in a position above the formation for which fluid flow regulation is desired. The shearable ball valve sleeve is pushed downwardly out of the inflatable packer by further increasing the fluid pressure above the level required to effect the setting of the inflatable packer. A larger ball is then dropped or pumped to engage the upwardly facing ball seat provided in the run-in tool. Adjusting the fluid pressure in the coiled tubing to a predetermined higher level will then effect the actuation of the fluid pressure actuated release mechanism and permit the run-in tool and the coiled tubing to be retrieved from the well.

The next step in this operation is to run-in by wireline a tubular flow regulating tool which has an internal contour constructed to sealingly cooperate with the now exposed upper end of the inflated packer, thus occupying the same position as the run-in tool previously occupied. The tubular flow regulating tool is further provided with a central choke element defining a fluid passage of the desired flow area. Such choke element is detachably secured by, for example, a collet or other means within the bore of the flow regulating tool. If a change in the flow rate into or out of the formation is desired, it is only necessary to run a wireline tool into the well to engage the choke element, remove same and reinsert another choke element having a more desirable flow area.

Another method of utilizing an inflatable packer embodying this invention is to effect the cementing of a lower production formation(s) which no longer produces economically justified amounts of hydrocarbons. The packer version of the inflatable tool is lowered through the production tubing string and the production packer on coiled tubing and is inflated at a position immediately above the lower production formation(s) which is to be cemented. The fluid pressure in the coiled tubing is then increased to a higher level to effect the blow-out of the shearably retained ball valve seat sleeve provided in the inflated packer. A cementing fluid can then be supplied through the coiled tubing to completely fill the well bore below the inflated packer. A second ball may be passed through the coiled tubing to seat on the upwardly facing ball valve seat provided in the run-in tool and the fluid pressure in the coiled tubing is adjusted to a predetermined level. Such fluid pressure effects the actuation of the fluid pressure actuating release mechanism contained in the run-in tool and the run-in tool releases from the inflatable packer, permitting the coiled tubing and the run-in tool to be withdrawn from the well.

When utilizing an inflatable packer having two axially spaced inflatable elements, a production formation producing an undesirable fluid, such as water, or an injection formation that absorbs excessive amounts of injection fluid, can be permanently isolated, without requiring the removal of the primary tubing string and packer. The dual element inflatable packer is inserted through the tubing string and the packer, if a packer is used, and positioned with the inflatable packing elements disposed respectively above and below the desirable formation After inflation of both inflatable elements by fluid pressure supplied through the coiled tubing, a ball is dropped to seat on the upwardly facing ball seat provided in the run-in tool. A further increase in fluid pressure in the coiled tubing will then effect the actuation of the fluid pressure actuated release mechanism to release the run-in tool from the inflated packer, permitting the coiled tubing and run-in tool to be removed from the well, while the particular formation remains isolated by the open bore, inflated packing tool.

Again, using an inflatable packer with dual, axially spaced inflatable packing elements, the problem of a leaking production packer may be efficiently overcome without pulling the leaking production packer from the well. The dual element inflatable packer is run into the well on coiled tubing through the production tubing string and is positioned so that the lower inflatable element engages the casing wall below the leaking packer while the upper inflatable element engages the bore of the packer, or the bore of a tubular extension provided on the packer which communicates with the bore of the tubing string. After inflation of both inflatable elements, fluid pressure in the coiled tubing is adjusted to actuate the fluid pressure actuated release mechanism, releasing the run-in tool from the inflated packer and permitting the coiled tubing and run-in tool to be withdrawn from the well. Thus, leakage of the production packer is effectively prevented for the life of the inflatable packer.

Further advantages and utilizations of inflatable tools embodying this invention will be readily apparent to those skilled in the art from the following detailed description, taken in conjunction with the annexed sheets of drawings, on which is shown a number of preferred embodiments.

BRIEF DESCRIPTIQN OF DRAWINGS

FIGS. 1A, 1B, 1C, 1D, 1E and 1F collectively constitute a vertical quarter sectional view of an inflatable tool involving this invention, here illustrated as comprising an inflatable bridge plug.

FIGS. 2A and 2B collectively constitutes a schematic vertical sectional view showing an inflatable tool embodying this invention, in this case constituting an inflatable packer, inserted in a well having a plurality of production formations, with the inflatable packing element of the inflatable packer positioned intermediate lower and upper production formations.

Figure 6A:
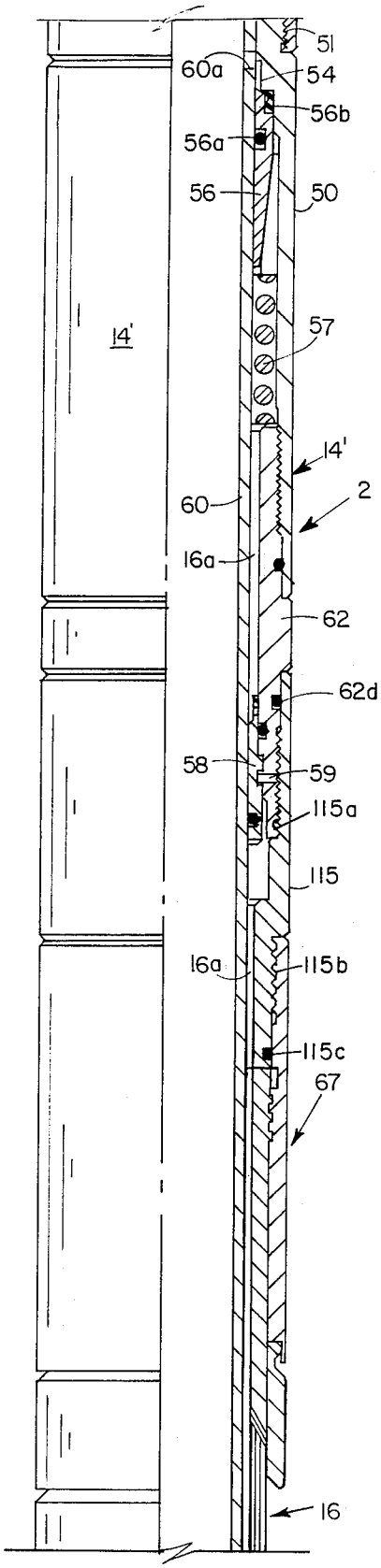
Figure 6B:
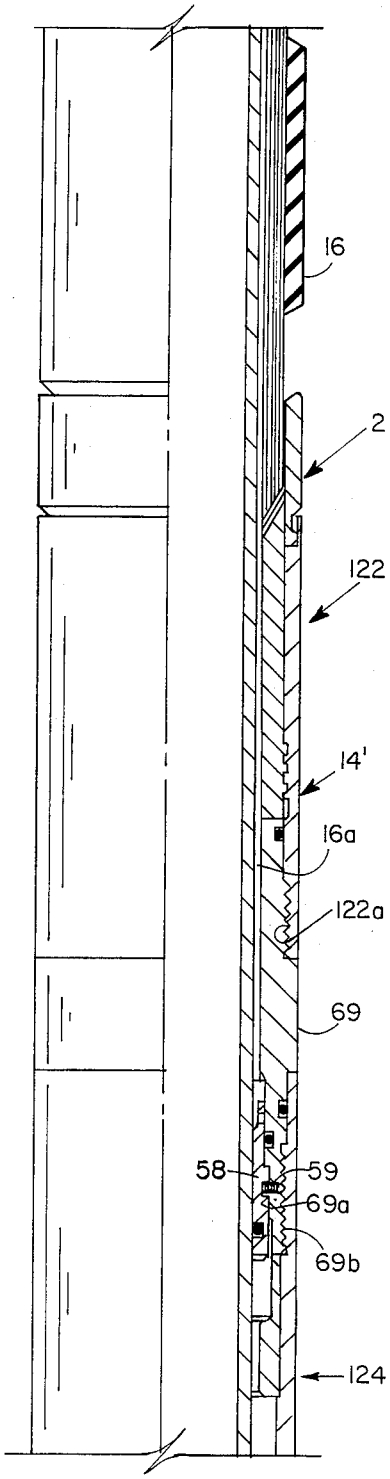
Figure 6C:
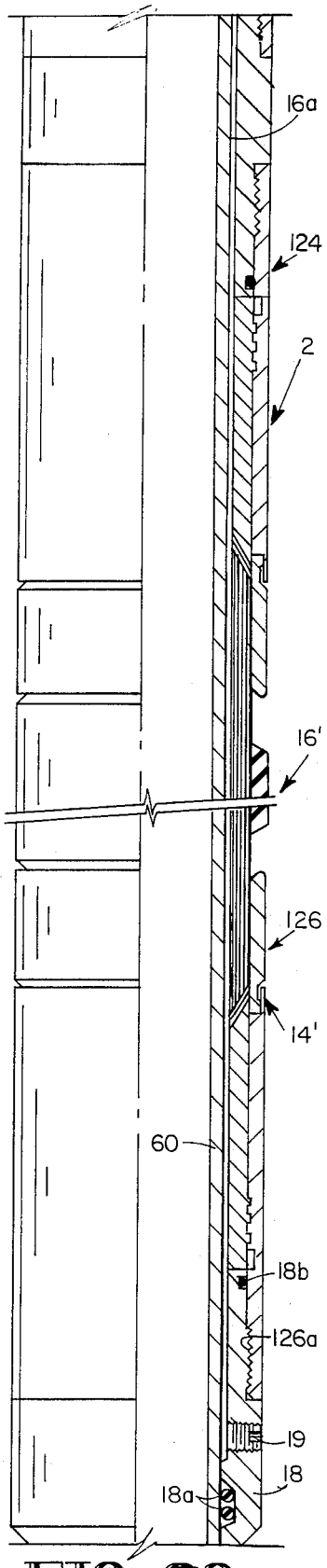

FIGS. 6A, 6B and 6C collectively constitute a schematic vertical quarter sectional view of a dual element packing tool embodying this invention.

Figure 7A:
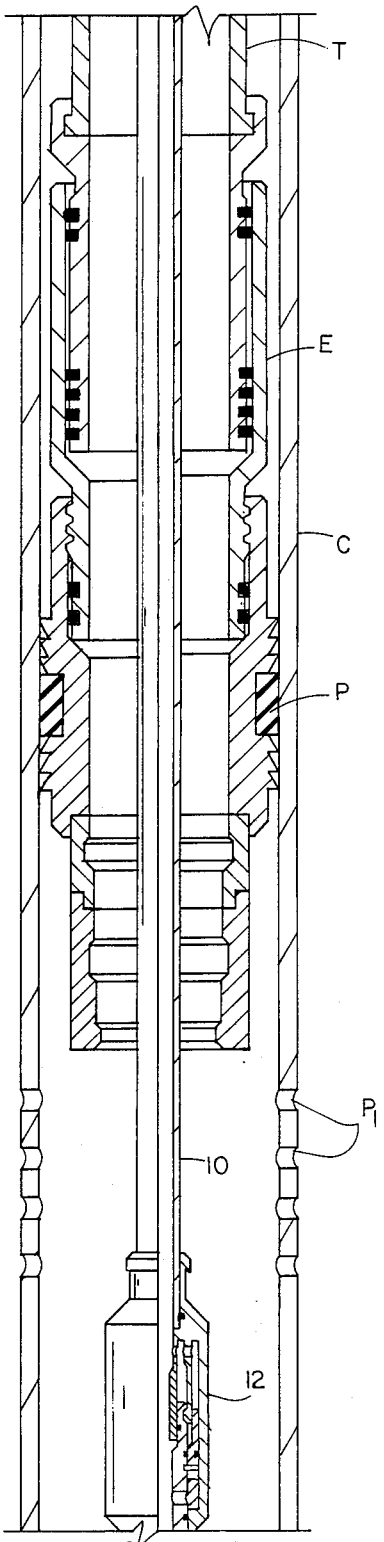
Figure 7B:
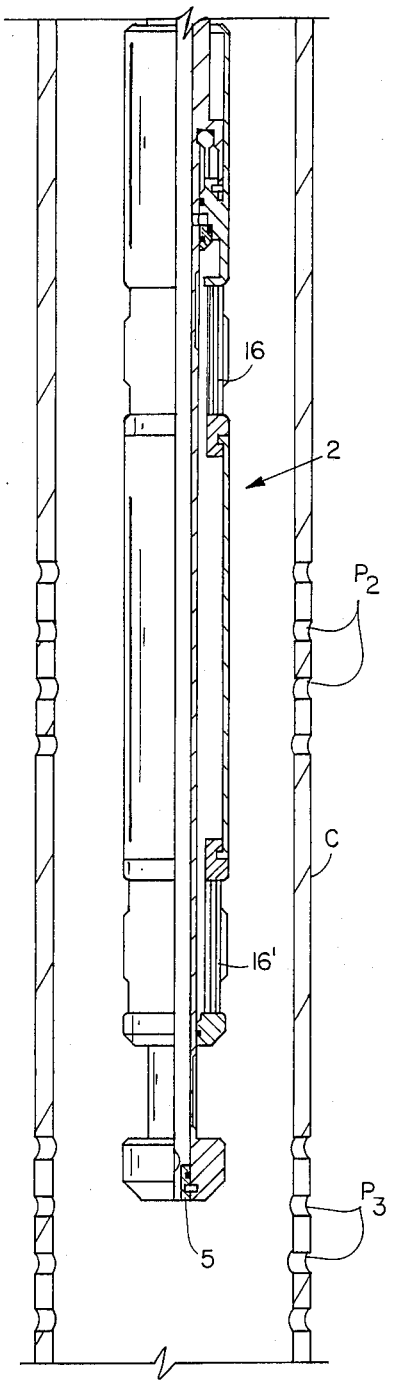

FIGS. 7A and 7B constitute a schematic vertical sectional view showing a dual element inflatable tool embodying this invention inserted in a well having a plurality of production formations, with the two inflatable packing elements positioned immediately above and below a selected production formation.

Figure 8A:
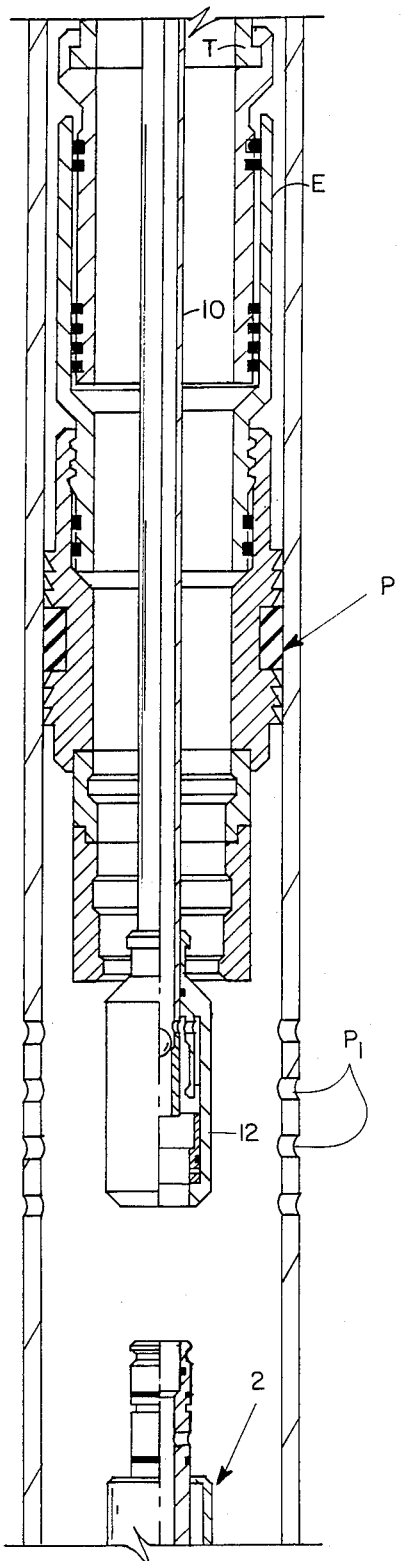
Figure 8B:
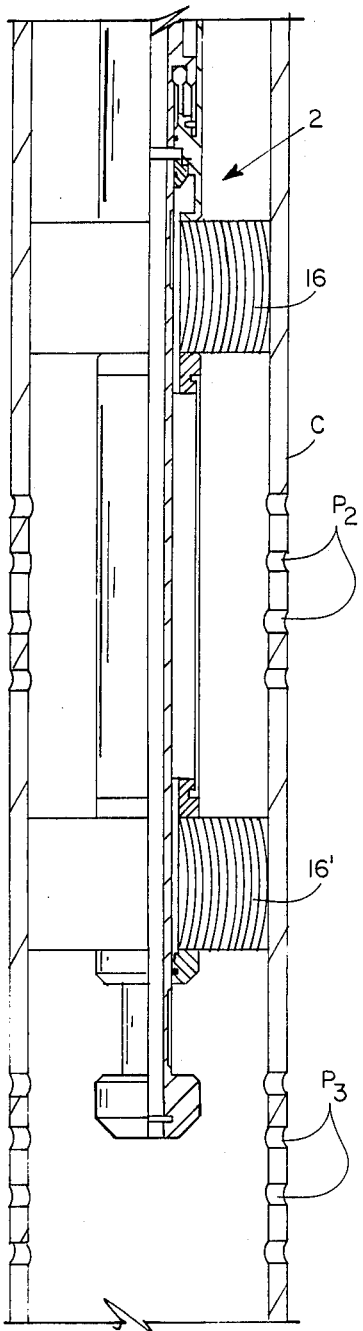

FIGS. 8A and 8B are views respectively similar to views FIGS. 7A and 7B but showing the inflation of the dual packers and the separation of the run-in tool.

Figure 9A:
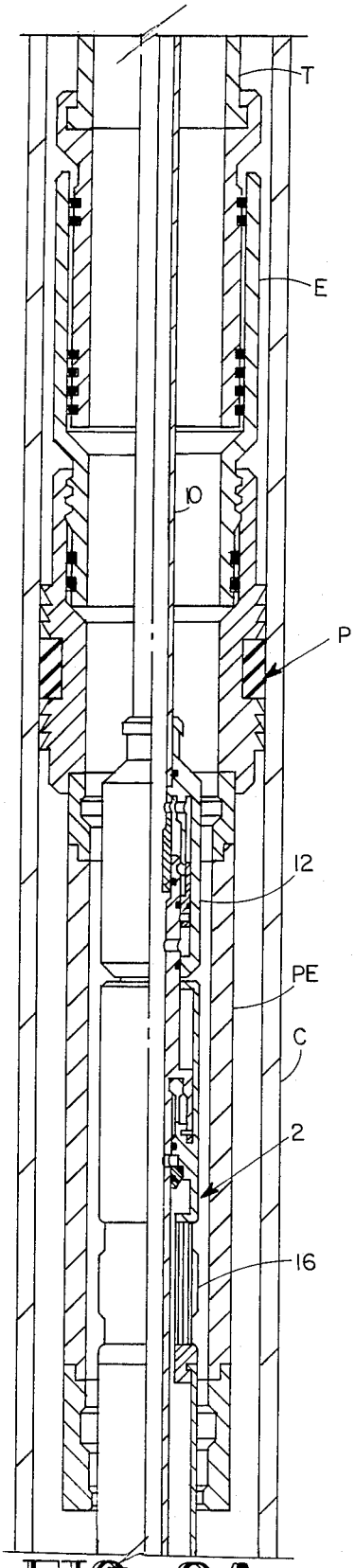
Figure 9B:
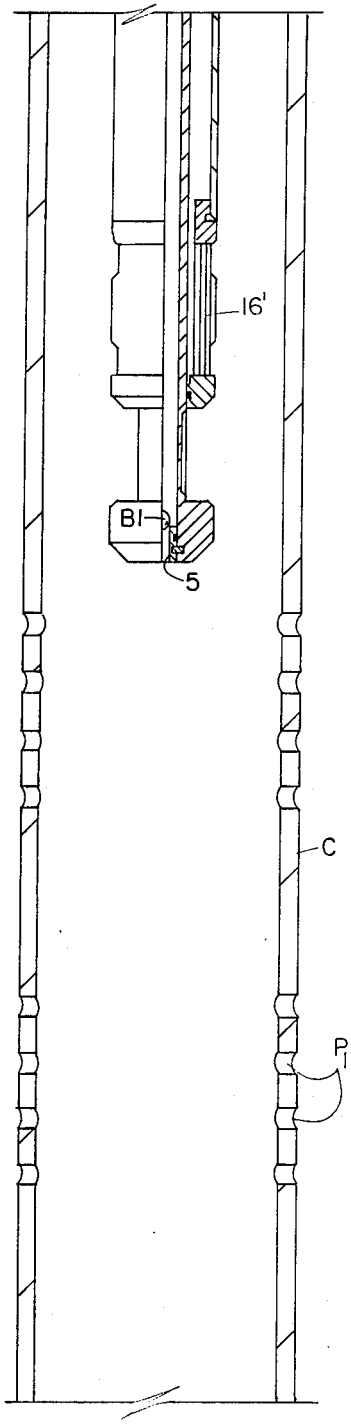

FIGS. 9A and 9B collectively constitute a schematic vertical sectional view showing a dual element inflatable tool embodying this invention inserted in a well having a leaking production packer to isolate the leaking production packer.

Figure 9C:
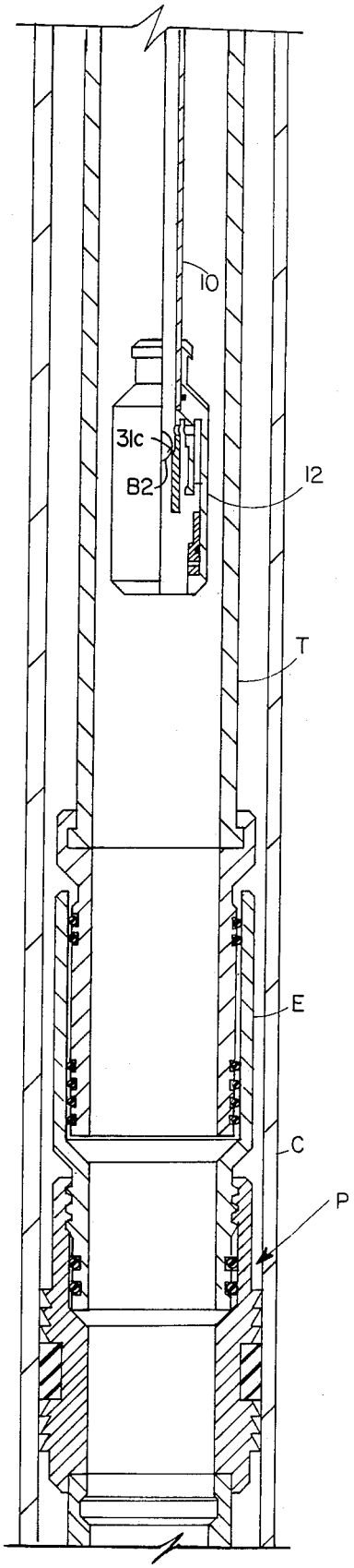
Figure 9D:
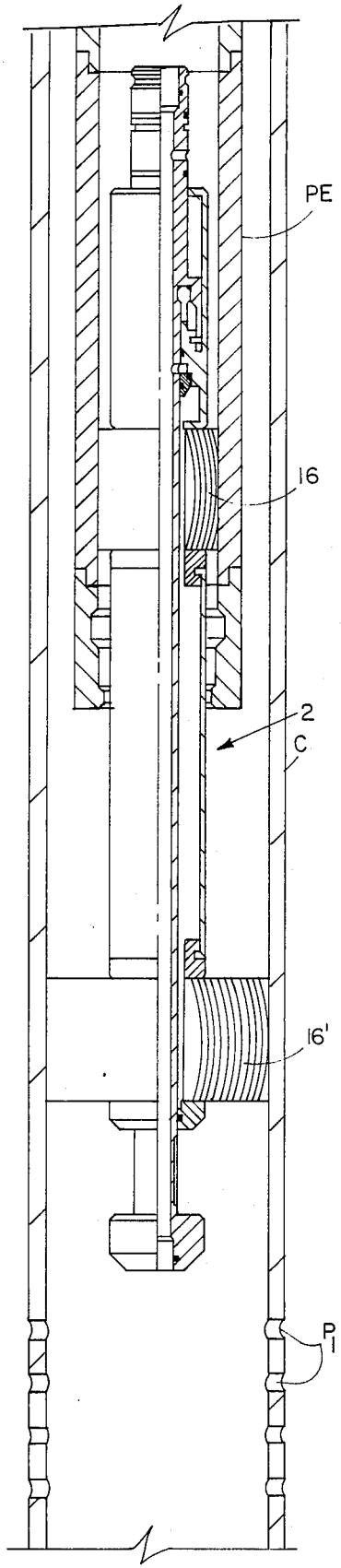

FIGS. 9C and 9D are views respectively similar to FIGS. 9A and 9B but showing the dual packing elements expanded and the run-in tool being removed.

DESCRIPTION OF PREFERRED EMBODIMENT

Referring to FIGS. 1A–1F, there is shown an inflatable tool 1 which is of the same general type as that described in the third of the above identified co-pending applications in that it will function as an inflatable bridge plug. The tool 1 differs from the tool described in the aforementioned co-pending application in that it incorporates a ball seating surface in the run-in tool to effect the fluid pressure actuated release of the run-in tool from the inflatable tool.

Either coiled tubing 10 or conventional threaded remedial tubing may be utilized to lower the packing tool 1 to its desired position in the well by passing through production or injection tubing and a packer, if one is used, to extend into the open bore of the casing and to be positioned intermediate production formations lying below the packer. These specific arrangements will be hereinafter described in detail. The inflatable packing tool 1 is inflated or "set" to seal against the interior bore surface of the casing, is subsequently deflated or "unset", and then may be retrieved to the surface through the production tubing. Inflation of the packing tool is controlled by passing fluid under pressure from the surface to a packing tool actuator assembly through coiled or remedial tubing 10.

The packing tool 1 includes a removable upper subassembly or run-in tool 12 (FIGS. 1A and 1B) and a main body assembly 14 (FIGS. 1B, 1C, 1D and 1E). The main body assembly controls passage of pressured fluid to an expandable packing element 16 (FIGS. 1D and 1E) to expand the packing element against the interior wall of a casing. A pressure equalizing sub 80 (FIG. 1F) is attached beneath the inflatable packer element 16 and is utilized to equalize pressure across the tool which takes place before the deflation operation. Below the pressure equalizing sub 80 a circulation housing 90 (FIG. 1F) forms the bottom of the inflatable tool 1.

The upper sub-assembly of run-in tool 12 includes a top sub 20 interconnected to the bottom end of coiled tubing 10 by a plurality of set screws 22. Top sub 20 includes a fishing neck portion 24 for receiving a conventional wireline fishing tool under circumstances described subsequently. The bottom end of top sub 20 is externally threaded at 26 for engagement with an upper pilot sub 28 carrying internal threads **28*a* and external threads 28*b* on its lower extremity. A collet 30 is threadably secured to internal threads 28*a* and the top end of an outer sleeve 32 is secured to external threads 28*b* and sealed by O-ring 28*c***.

Collet 30 is provided with a plurality of peripherally spaced, depending arm portions **30*a* which respectively terminate in enlarged head portions 30*b*. Additionally, collet 30 is proprovided with an internal upwardly facing shoulder 30*c* which secures a ported sleeve 31 in position against a downwardly facing surface 28*d* formed on the upper pilot sub 28. Ported sleeve 31 is provided with a plurality of peripherally spaced, downwardly and outwardly extending ports 31*a* for supplying fluid pressure to an annular chamber 33 defined within the interior of outer sleeve 32. A tubular upper body portion 40 projects upwardly from the body assembly 14 and terminates in a fishing neck portion 44 lying within the annular chamber 33. The enlarged collet head portions 30*b* cooperate with an annular groove 44*a* provided in the fishing neck portion 44 and the collet heads are secured in engagement with the fishing neck portion 44 by the reduced thickness top end 36 of an annular piston 34. Annular piston 34 is provided with an O-ring seal 34*a* cooperating with the inner wall of sleeve 32 while an O-ring seal 44*b* provided in the outer wall of the tubular body portion 40 cooperates with the inner wall of the lower portion 38 of the piston 34**.

The annular chamber 33 is completed by the top end portion 52 of a hollow mandrel assembly 5. The top of the upper end portion 52 of mandrel assembly 5 is formed as a fishing neck 54 and also mounts an O-ring **54*a* which sealably engages the outer wall of the ported sleeve 31. Thus, fluid pressure entering the annular chamber 33 is confined and acts upon the enlarged lower portion 38 of the piston 34 to exert a downward force on piston 34. The piston is secured in its upper position illustrated in FIG. 1B by a shear screw 35 which traverses the piston and engages a suitable notch 44*c* provided on the exterior of the tubular body 40. In this position, the upper end 36 of piston 34 is in abutting engagement with the collet heads 30*b*, holding such heads in engagement with the locking notch 44*a* provided in the tubular body 40, thus securing the run-in tool 12 to the main body 14 of the inflatable tool 1**.

The top inner surface **31*c* of the ported sleeve 31 is provided with an inclined, upwardly facing surface configuration 31*c* so that it will receive a ball in sealing relationship, but such seal will not interfere with fluid flow through the ports 31*a*. Thus, when a ball (not shown) is dropped or pumped through the coiled tubing to seat on the inclined surface 31*c*, fluid pressure in the coiled tubing 10 may be increased to apply a downward fluid pressure force to the annular piston 34. When such force is increased to a level sufficient to effect the shearing of shear screw 35, the piston 34 will be shifted downwardly and the collet heads 30*b* will be released from engagement with the locking notch 44*a* provided in the upper end of the tubular body portion 40. In this manner, the run-in tool 12 is completely released from the remaining body portion 14 of the inflatable tool 1 and the run-in tool 12 together with the dropped ball and the coiled tubing can be raised upwardly relative to the remainder of the inflatable tool 1** or retrieved from the well, for purposes to be hereinafter described.

Figure 1A:
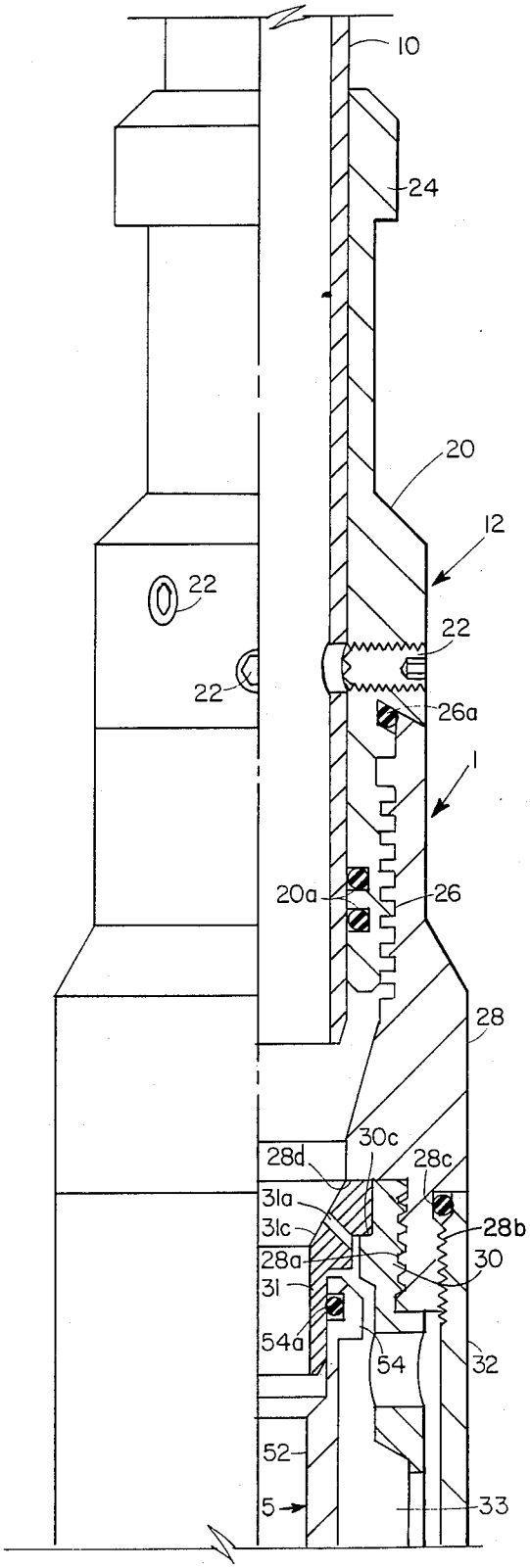
Figure 1B:
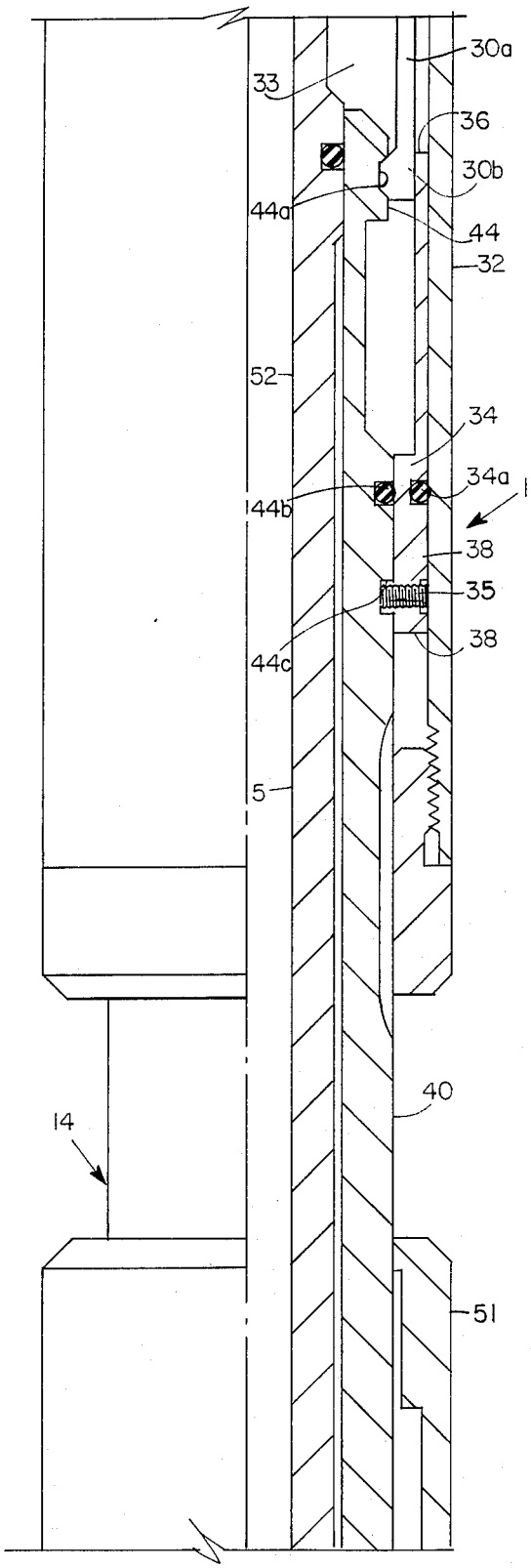
Figure 1C:
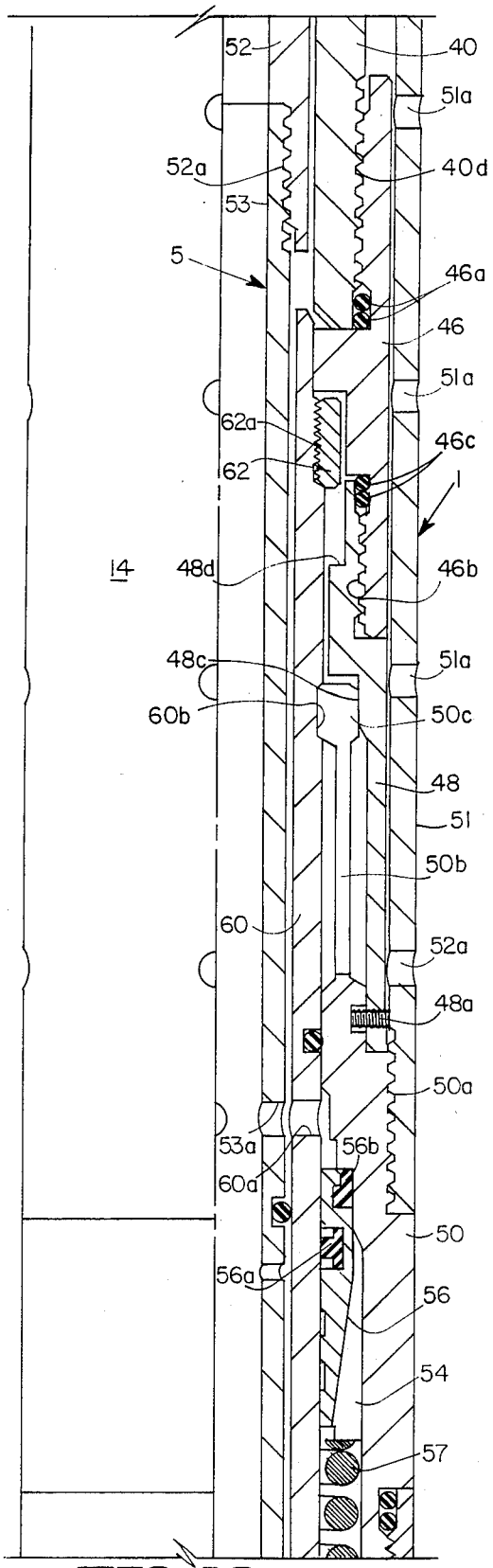
Figure 1D:
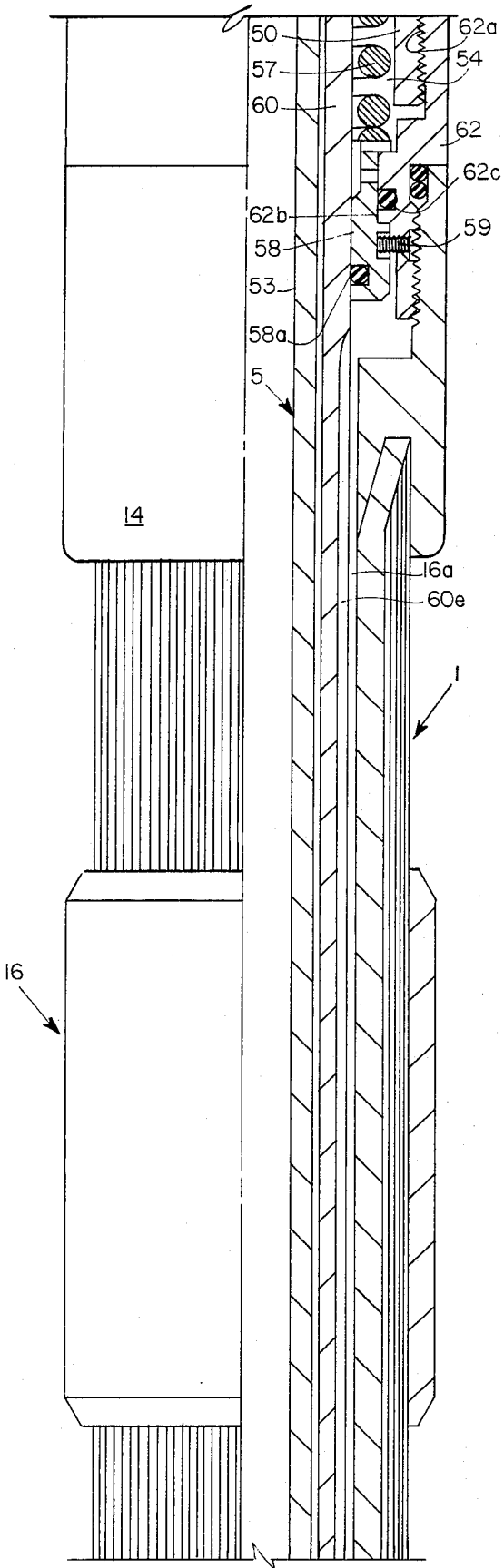

Referring now to FIG. 1C, the tubular body portion 40 of the inflatable tool 1 terminates in an external threaded section **40*d* which is threadably and sealably engaged with the top end of a connecting sub 46. O-rings 46*a* seal the threaded connection At the same general location, the mandrel 52 is secured by threads 52*a* to an intermediate mandrel extension 53. The lower portion of connecting sub 46 is internally threaded as indicated at 46*b* to the top end of the mechanical latching sub 48 (FIG. 1C). Threads 46*b* are sealed by O-rings 46*c***.

The mechanical locking sub 48 is shearably secured at its lower end by a plurality of peripherally spaced shear screws **48*a* to the top end of an intermediate body portion 50 of the inflatable tool 1. External threads 50*a* on such intermediate body portion 50 provide a connection for the bottom end of an outer sleeve housing 51 which is provided with a plurality of vertically spaced ports 51*a*** which maintain the interior of outer sleeve housing at the well annulus pressure.

The upper tubular body portion 40 is detachably secured against relative movement with respect to the intermediate outer body portion 50 by a plurality of collet arms **50*b* integrally formed in upstanding relationship on the top end of the intermediate outer body portion 50 and terminating in enlarged head portions 50*c*. The head portions 50*c* in turn engage an annular external groove 60*b* provided on the outer periphery of an inner body sleeve 60. In the run-in position of the tool, the collet heads 50*c* are secured in engagement with the locking groove 60*b* by the abutting engagement of an internally enlarged cylindrical surface 48*c* formed on the interior of the mechanical locking sub 48. Thus, when a mechanical force is applied to the upper tubular body portion 40 by engaging the fishing neck 44 at the top thereof by a wireline tool, the resulting upward force will effect the shearing of screw 48*a* in the mechanical locking sub 48, thus releasing the mechanical locking sub 48 to move upwardly to free the collet heads 50*c* for radially outward movement out of the groove 60*b* provided on the inner body sleeve 60. After sufficient upward movement of the upper tubular body portion 40 to effect the release of the collet heads 50*c*, an upwardly facing, internal shoulder 48*d* on sub 48 moves into engagement with an abutment ring 62 threadably secured by threads 62*a* to the exterior of the top end of the inner body sleeve 60 and effects the elevation of such inner body sleeve 60 to deflate the inflatable element 16**, in a manner to be subsequently described.

Proceeding downwardly from the intermediate outer body portion 50, the structure down through expanded element 16 is identical to that described in the above referred to co-pending application Ser. No. 112,888, filed 10/23/87. Thus the inner body sleeve 60 is provided with a plurality of peripherally spaced, radial ports 60*a* which communicate with an annular valving chamber 54 defined between the interior of the outer body portion 50 and the exterior of inner body sleeve 60. A check valve 56 is mounted in such chamber to prevent downward fluid flow therethrough and is spring biased to a closing position by a spring 57. Elastomeric seals 56*a* and 56*b* are secured to the inner and outer portions of the check valve 50 to provide sealing engagement respectively with the exterior of the inner body sleeve 60 and the interior of the outer housing portion 50, thus preventing downward flow of pressured fluid through the chamber 54 until the fluid pressure exceeds the bias on check valve 56 produced by the spring 57. Below the spring 57, a delayed inflation sleeve valve 58 (FIG. 1D) is slidably and sealably mounted between the exterior wall of the inner tubular body sleeve 60 and the interior wall 62*b* of a connecting sub 62 which is secured by threads 62*a* to the bottom end of the intermediate outer housing portion 50. An elastomeric seal 58*a* effects the sealing of the delayed inflation valve 58 to the outer wall of the inner body sleeve 60 while an O-ring 62*c* provided in the connecting sub 62 effects the sealing of the exterior wall of the delayed inflation sleeve valve 58. A shear screw 59 secures the delay inflation valve 58 in its run-in, closed position until the fluid pressure in the chamber 54 reaches a value sufficient to effect the shearing of shear screw 59. Sleeve valve 58 then moves downwardly to an open position.

When sufficient fluid pressure is applied through the coiled tubing 10, and hence through the bore of the hollow mandrel assembly 5, such fluid pressure will flow through ports 53*a* provided in the intermediate portion 53 of hollow mandrel assembly 5 in alignment with ports 60*a* provided in the inner body sleeve 60, and thence into the valving chamber 54, thus effecting the inflation of the inflatable element 16 by passing downwardly through a narrow annular passage 16*a* defined between the interior of the inflatable element 16 and the exterior of the inner body sleeve 60.

Figure 1E:
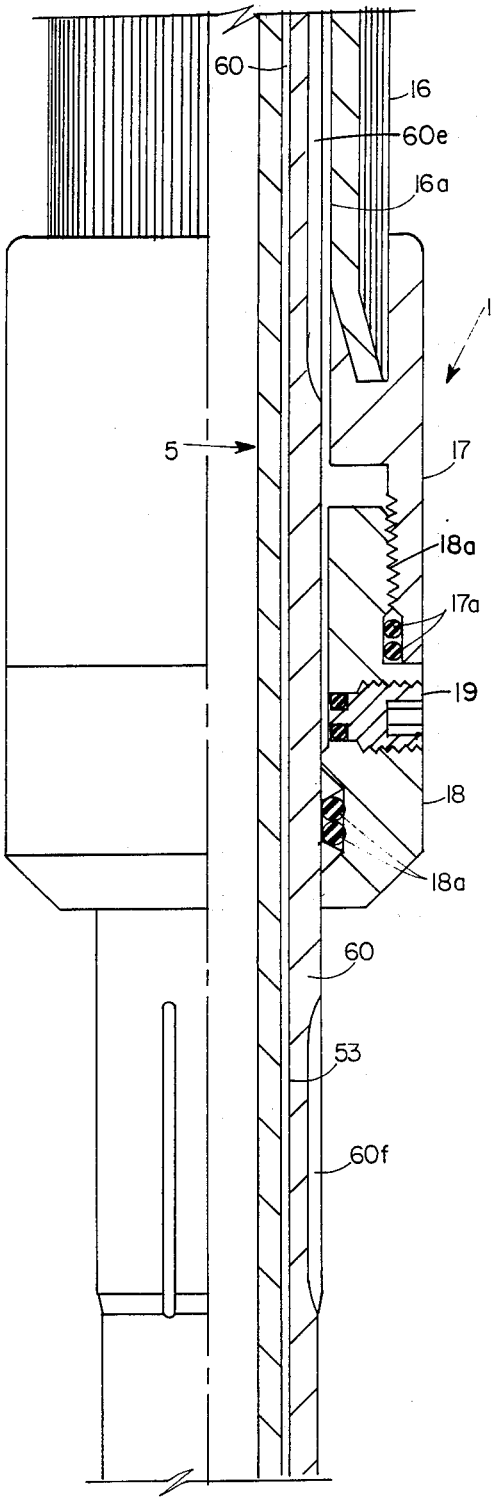

The inflatable element 16 is entirely conventional in construction and hence will not be described in detail. Referring to FIG. 1E, the lower end of the inflatable element 16 is secured in an anchoring sub 17 which in turn is threadably secured by threads 18*a* to a sealing sub 18. O-rings 17*a* seal this threaded connection. The sealing sub 18 is provided with O-rings 18*a* which are disposed in sealing engagement with the outer wall of the inner body sleeve 60. If desired, a fluid drainage plug 19 may be sealably inserted in the wall of the sealing sub 18 to effect a complete drainage of fluid from the interior of the inflatable element 16 when the apparatus is removed from the well.

Figure 1F:
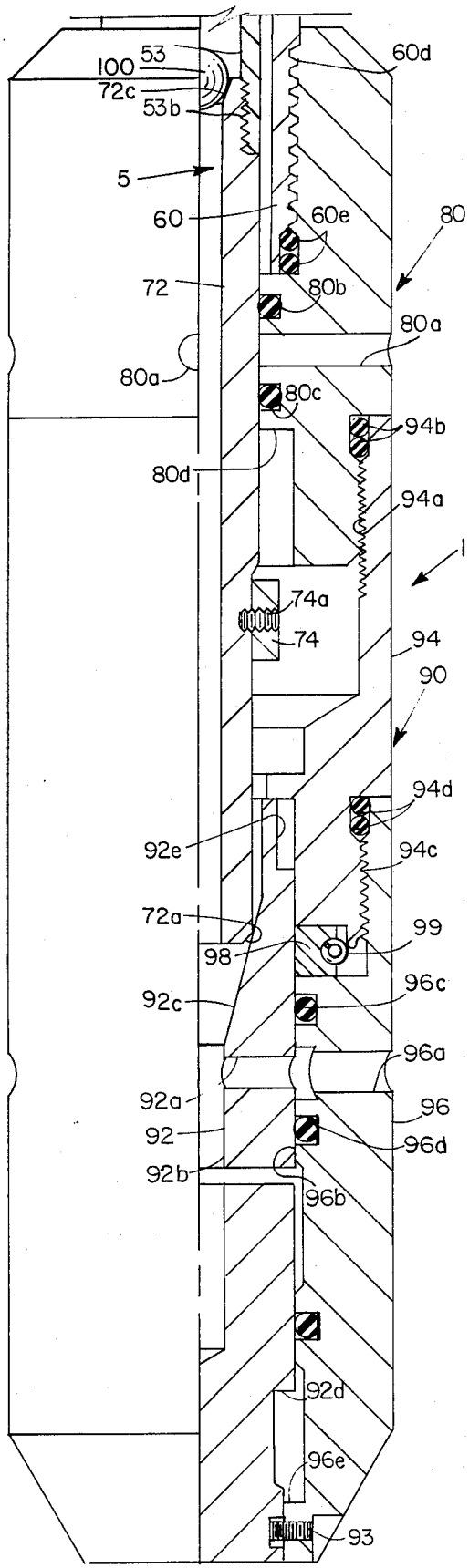

Referring now to FIG. 1F, the inner body sleeve 60 is provided with external threads 60*d* at its bottom end and connects to a pressure equalizing sub 80. The threaded connection is sealed by O-rings 60*e*. Pressure equalizing sub 80 is provided with a plurality of peripherally spaced radial ports 80*a* and mounts O-rings 80*b* and 80*c* respectively above and below such ports. The O-rings 80*b* and 80*c* cooperate with the external surface of a lower mandrel extension sleeve 72 which is secured to the intermediate mandrel extension sleeve 53 by threads 53*b*. Downward displacement of the entire mandrel assembly 5 is prevented by the engagement of the bottom end 72*a* of the bottom mandrel extension sleeve 72 with a shiftable valve element 92 provided in the circulation valve assemblage 90. Upward movement of the mandrel assemblage is prevented by an abutment ring 74 which is shearably secured by a screw 74*a* to the exterior of the bottom mandrel extension 72 and which will abut with downwardly facing shoulder 80*d* provided on the pressure equalizing sub 80.

A circulation assemblage 90 comprises an upper mounting sub 94 having internal threads 94*a* for engagement with external threads provided on the lower end of the equalizing sub 80. O-rings 94*b* seal this threaded connection.

The upper portion 94 of the circulation assembly 90 is threadably connected at its lower end by threads 94*c* to the upper end of a ported housing 96. O-rings 94*d* seal this threaded connection. Ported housing 96 defines a plurality of peripherally spaced radial ports 96*a*, each of which intersect an internal bore surface 96*b* formed in the ported housing 96. A plug valve element 92 sealingly engages a pair of O-rings 96*c* and 96*d* respectively disposed above and below the radial ports 96*a*. In the run-in position shown in FIG. 1F, a plurality of radial ports 92*a* are provided in the upper sleeve portion 92*b* of the valve plug 92. The plug valve 92 is secured with the ports 92*a* in alignment with the ports 96*a* by one or more shear screws 93. The sleeve portion 92*b* of the valve plug 92 is further provided with an upwardly facing, inclined surface 92*c* which functions as a stop for downward movement of the lower portion 72 of the mandrel assemby 5. An upwardly facing inclined surface 72*c* is formed on the upper end of lower mandrel portion 72 which functions as a ball seat to receive a ball 100 so that increased fluid pressure supplied through the coiled tubing 10 will exert a downward force on the valve plug 92 sufficient to shear the screw 93 and move the valve plug to its lowermost position wherein a downwardly facing surface 92*d* on the valve plug engages an upwardly facing surface 96*e* provided on the lower housing 96.

In this lower position, the ports 92*a* in the valve and hence the bore of the inflatable tool 1 is effectively closed at the bottom. Additionally, in this lower position, an annular locking recess 92*e* provided on the top outer surface of the valve plug 92 is engaged by a segmented locking lug 98. A circular tension spring 99 provides the radially inward bias for the locking lug 98.

In the normal operation of the inflatable tool 1, the tool 1, with its elements in the positions shown in FIGS. 1A–1F, is lowered through a tubing string, such as a production tubing, which is installed in a well and may terminate in a production packer. The inflatable tool 1 is lowered through the tubing string and the packer so that the inflatable element 16 occupies a position below the uppermost production formation. During run-in, circulation can be maintained through the aligned open circulating ports 96*a* and 92*a*.

Once the inflatable tool 1 is properly positioned in the well, the ball 100 is dropped or pumped to seat on the upwardly facing inclined surface 72*c* and effect a seal therewith. Pressured fluid is then supplied to the coiled tubing 10 and this pressured fluid exerts a downward force on the valve plug 92 until the shear screw 93 is sheared and the valve plug 92 is moved to its lower position where the circulation ports 92*a* and 96*a* are misaligned and the central bore through the tool is effectively plugged.

A further increase in fluid pressure supplied through the coiled tubing 10 will effect the setting of the inflatable element 16 by depressing the check valve 56 and effecting the shearing of the pin 59, permitting the inflation delay sleeve valve 58 to move downwardly to supply the pressured fluid to the interior of the inflatable element 16. When the pressure supplied by the coiled tubing 10 is reduced, the tool nevertheless remains in an inflated position due to the sealing action of the check valve 56, which traps the inflation pressure within the interior of the inflatable element 16.

To disconnect the run in tool from the bridge plug, pressure is applied down the coiled tubing to inflate the element and this same pressure activates the disconnect. No ball is required. If, however, it becomes necessary to disconnect and pressure cannot be applied to the tool (because the element has ben ruptured during inflation or another leak has developed), a ball can be dropped and pressure applied to the ball to activate the disconnect). An increase in fluid pressure supplied through the coiled tubing 10 will then act directly on the upper end of the locking piston 34 (FIG. 1B), shearing shear screw 35 to permit such piston to move downwardly so that the top end 36 of piston 34 no longer abuts the collet heads 30*b*, permitting such collet heads to move out of engagement with the recess 44*a* provided in the top of the upper body portion 40. The run-in tool 12 can then be removed from the inflated tool 1 and carries with it the ball which was employed to generate the fluid pressure to actuate the fluid pressure responsive release mechanism.

If at a subsequent time, it is desired to remove the inflated tool 1 from the well, this may be conveniently accomplished by wireline operations. A wireline fishing tool is lowered into the well and first engages the fishing head 54 provided on the top end of the upper mandrel portion 52. The mandrel assembly 5, including top portion 52, intermediate portion 53 and bottom portion 72 (FIG. 1F), can then be removed from the well. The removal of the bottom portion 72 effects an opening of the pressure equalizing ports 80*a* provided in the pressure equalizing sub 80 and the fluid pressure above and below the inflated packing element 16 is thus equalized.

A second trip with a wireline fishing tool permits the wireline to be engaged with the fishing neck 44 (FIG. 1B) provided on the upper end of the body portion 40. An upward force exerted on the body portion 40 effects the severing of the shear screws 48*a* (FIG. 1C) to permit upward movement of locking sub 48 which holds the collet heads 50*c* in locking engagement with the annular groove 60*b* provided in the tubular inner body portion 60. Subsequent upward movement of the upper body portion 40 releases the collet heads 50*c* and permits the shoulder 48*d* on the mechanical latching sub 48 to move into engagement with the abutment ring 62 secured to the inner body sleeve 60 and hence move the body sleeve 60 upwardly. Such upward movement brings axially extending grooves 60*e* (FIGS. 1D and lE) formed in the periphery of the inner body sleeve 60 into bridging relationship with respect to the elastomeric seal 56*a* provided on the check valve 56, thus permitting pressured fluid within the inflatable element 16 to exhaust to the well annulus at the upper end of the inflatable tool. Concurrently, a plurality of axially extending grooves 60*f* provided in the lower portions of the inner body sleeve 60 are moved into bridging relationship with the O-ring seals 18*a* provided in seal sub 18 at the bottom of the inflatable element 16 and thus pressured fluid is concurrently exhausted to the well annulus at the bottom of the inflatable element 16. With the deflation of element 16, the upward movement of the wireline can be continued to remove the entire inflatable tool from the well.

In order to convert the bridge plug into a packer the bypass sub 80 is replaced, as well as the circulation assemblage 90 and the plug valve element 92 with the circulation assemblage 46 and the ball seat 44. The mandrel assembly 5 also is removed and the upper tubular body portion 40 is replaced with the upper tubular body portion 37 and sleeve 38 with shear pin 40. The tubular body portion 37 provides proper porting for piston 34 so that a ball is required to disconnect from the tubing. The equalizing sleeve provides a means of equalizing across the tool before deflation. When the packer is used in application where it is disconnected from the tubing, i.e., a choke receptacle packer, there is no need for pressure equalization.

When used as a packer, the inflatable tool 1 heretofore described has the unique advantage that the run-in tool and the coiled tubing may be completely detached from the inflated packer and the bore of the inflated packer is left free of any obstructions such as a setting ball. When used as a bridge plug, the inflated packer may be conveniently deflated by equalization of the fluid pressure above and below the inflated element 16, followed by removing the mandrel assembly 52, 53 and 72 from the tool and from the well.

These unique characteristics permit a variety of new methods of utilization of inflatable tools, particularly in completed wells having a packer set in the well and tubing, such as production tubing or injection tubing, connected between the packer and the well surface. If the well includes a plurality of production or injection formations, a variety of operations can be performed on selected ones of such production formations by inserting an inflatable tool such as heretofore described through the primary tubing string and the packer to effect the setting of the inflatable packer either above or below a selected formation. If set below a formation to be treated, the bridge plug version of the inflatable tool may be utilized to isolate such formation and treatment fluids supplied through the primary tubing string. If set above the formation, the open bore packer version of the tool is employed and treatment fluids are supplied through the coiled tubing.

Figure 2A:
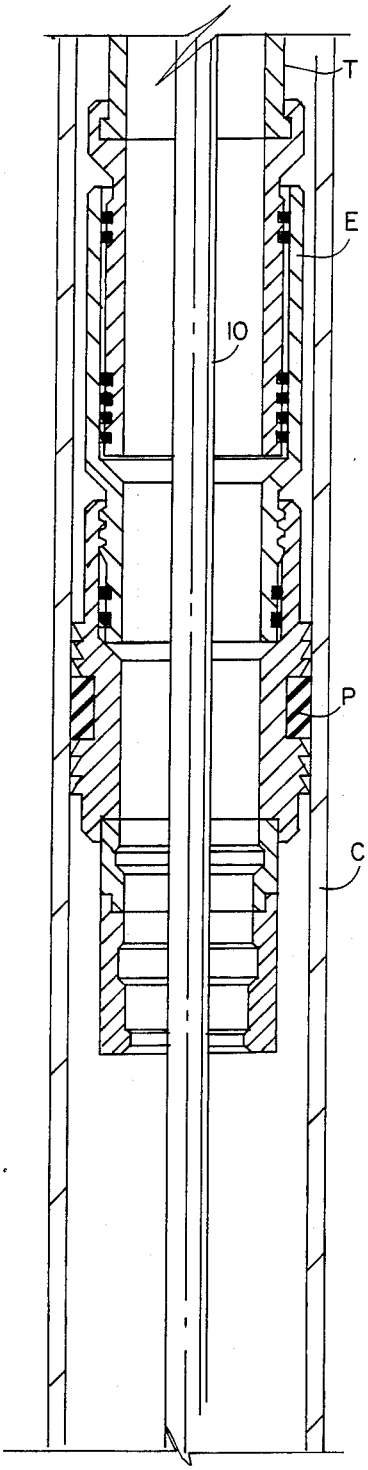
FIGS. 2C and 2D are views respectively similar to FIGS. 2A and 2B but showing the packer inflated and the run-in tool disconnected therefrom
Figure 2B:
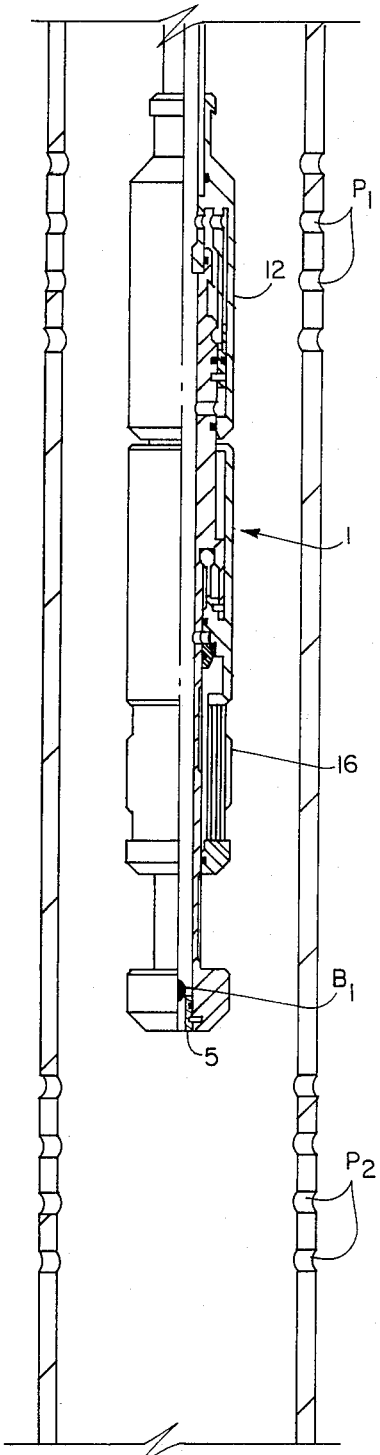
Figure 2C:
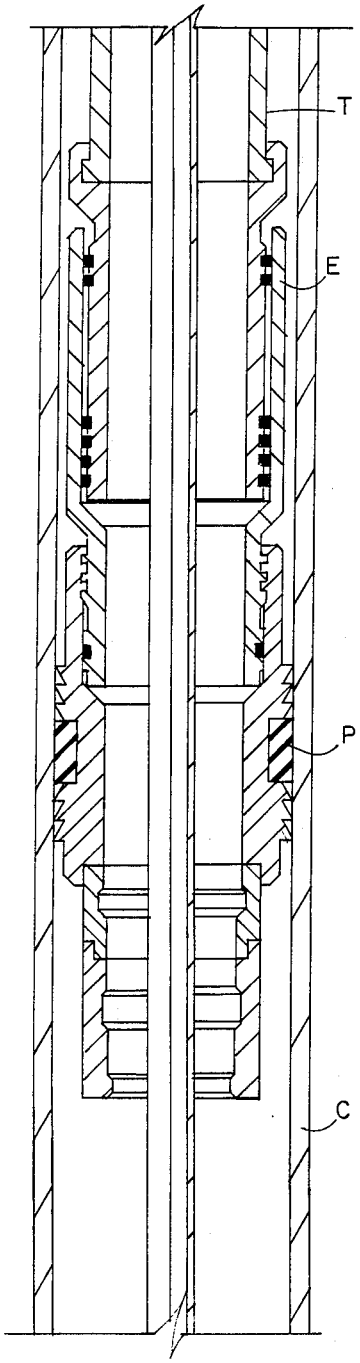
Figure 2D:
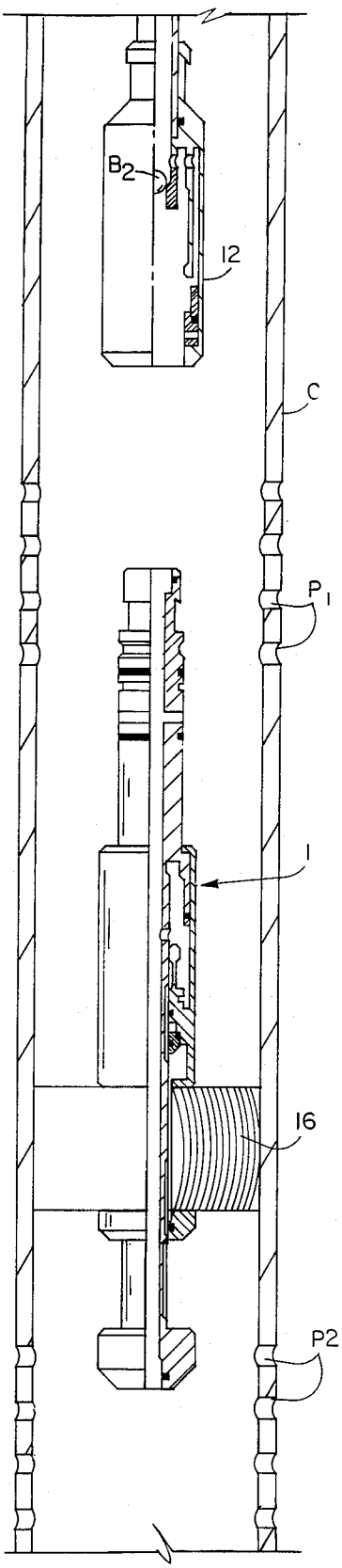

Referring now to FIGS. 2A and 2B, there is shown an inflatable packer 1 which has been run through tubing T, an expansion joint E, and the bore of a conventional packer P to position the inflatable element 16 of such inflatable tool intermediate a pair of production formations indicated by the perforations Pl and P2 in the casing C. Assume that the characteristics of the production formation communicating with the perforations P2 are such that it is desirable to limit the amount of treatment fluid supplied to that formation or, con versely, to limit the amount of fluid flowing out of that formation. Either of these objectives can be accomplished by the following procedure. First, referring to FIGS. 2A and 2B, a ball B1 is dropped to seat on the ball seating sleeve shearably mounted in the bore of the inflatable packer 1. Fluid pressure is then supplied through the coiled tubing 10 to effect the inflation and setting of the inflatable packer element 16 into sealing engagement with the wall of casing C. The pressure is then increased to a level sufficient to effect the shearing of the shearable ball seating sleeve 5 to force such elements out of the bore of the inflatable packer 1, as shown in FIG. 2D.

A second ball B2 (FIG. 2D) is then dropped to seat on the upwardly facing ball seating surface 31*c* provided in the run-in tool 12 and fluid pressure is again supplied through the coiled tubing 10 at a predetermined level than that required to effect the inflation of the inflatable element 16. Such higher fluid pressure effects the actuation of the fluid pressure actuated release mechanism incorporated in the run-in tool 12, and the run-in tool 12 and the coiled tubing 10 may be removed from the well leaving the packer 1 set in the well as shown in FIGS. 2C and 2D.

Figure 3A:
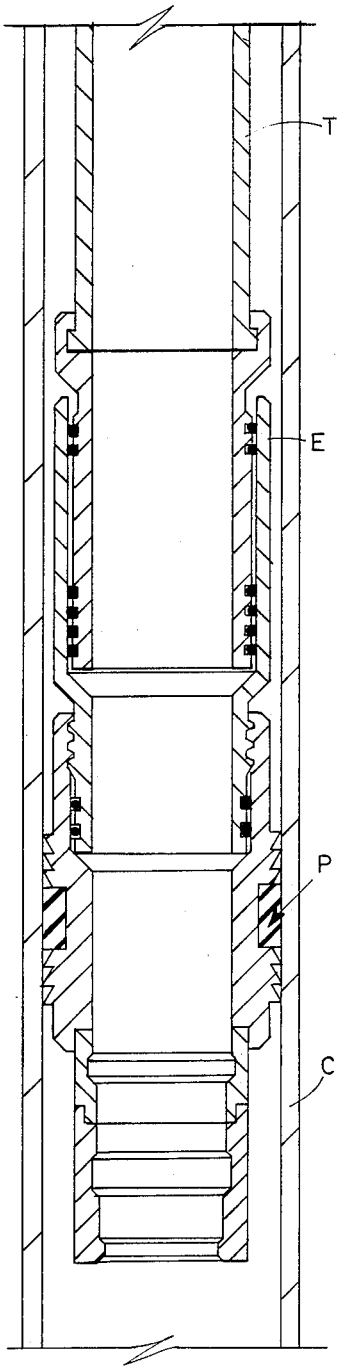
FIGS. 3A and 3B are views respectively similar to FIGS. 2C and 2D but showing the run-in tool removed and a flow regulating tool installed in the former position of the run-in tool.
Figure 3B:
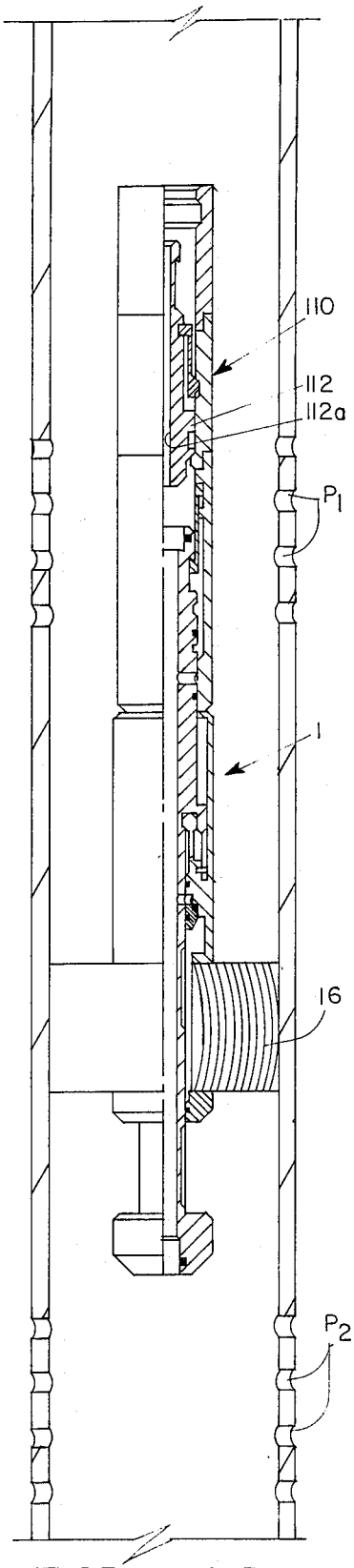
Figure 4A:
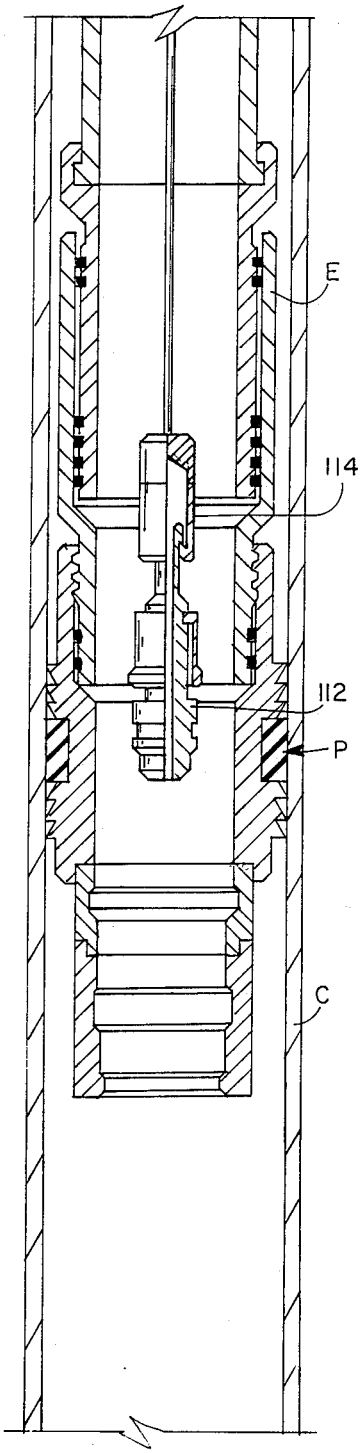
FIGS. 4A and 4B are views respectively similar to FIGS. 3A and 3B but illustrating the removal of a flow regulating choke from the flow regulating tool.
Figure 4B:
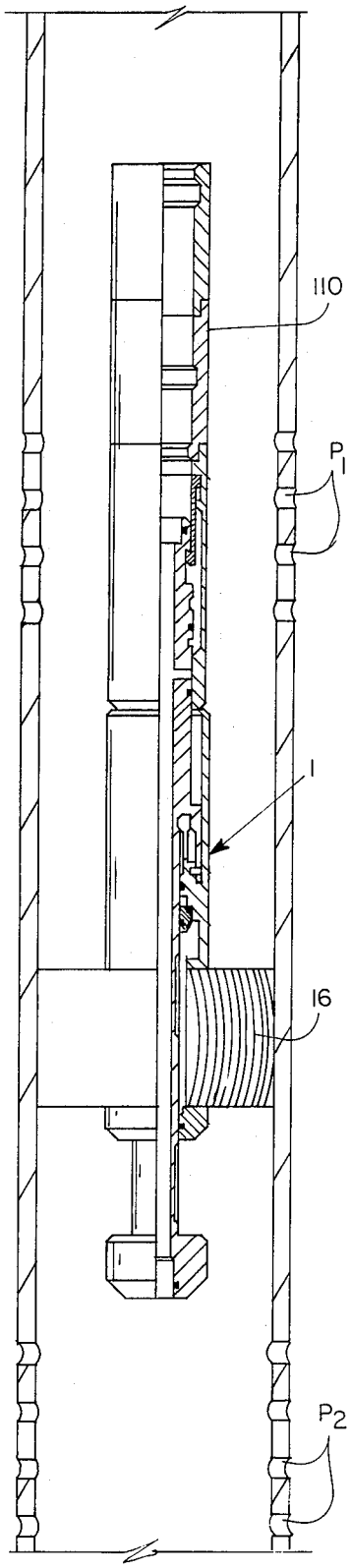

A tubular flow regulating tool 110 is then run into the well by wireline and secured to the inflated packer 1 in the position vacated by the removal of the run-in tool 12, as shown in FIGS. 3A and 3B. The flow regulating tool 110 incorporates in its bore a wireline removable choke element 112 having a bore 112*a* of a selected fluid passage area. Thus, any flow into the production formation adjacent the lower perforations P2, or out of such production formation, will be strictly regulated by the flow area of the choke 112. If, for any reason, it is desired to increase or decrease such flow, a wireline operation will permit the removal of the choke 112 by wireline tool 114 (FIGS. 4A and 4B) and the reinsertion of another choke with a bore having a different flow area. It should be noted that all of these operations can be accomplished without killing the well.

Figure 5A:
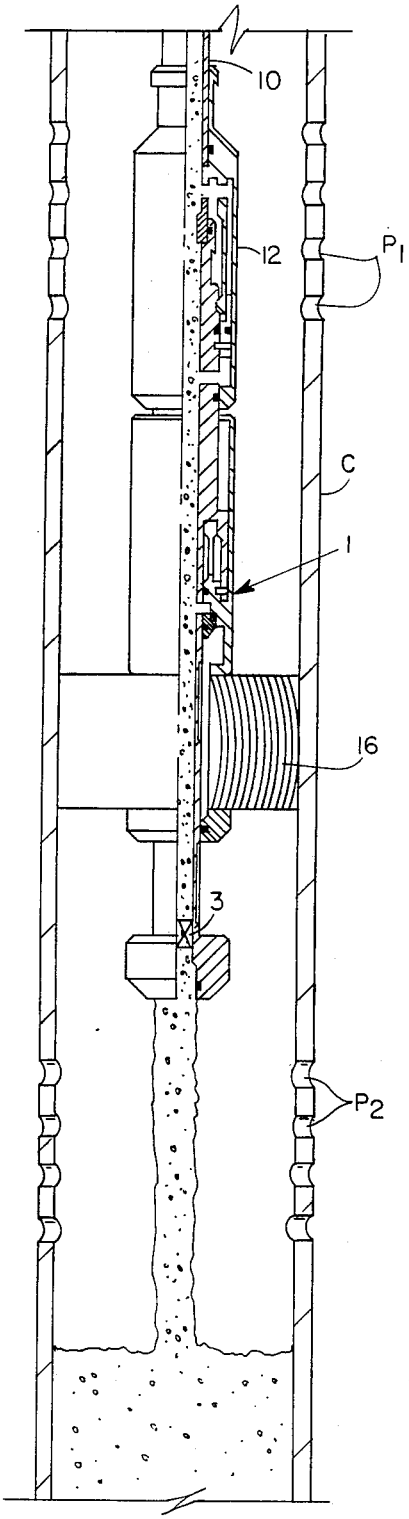
FIG. 5A is a schematic vertical sectional view showing the packer in an inflated condition with the coiled tubing connected thereto for supplying cement to a formation located below the inflated packer.
Figure 5B:
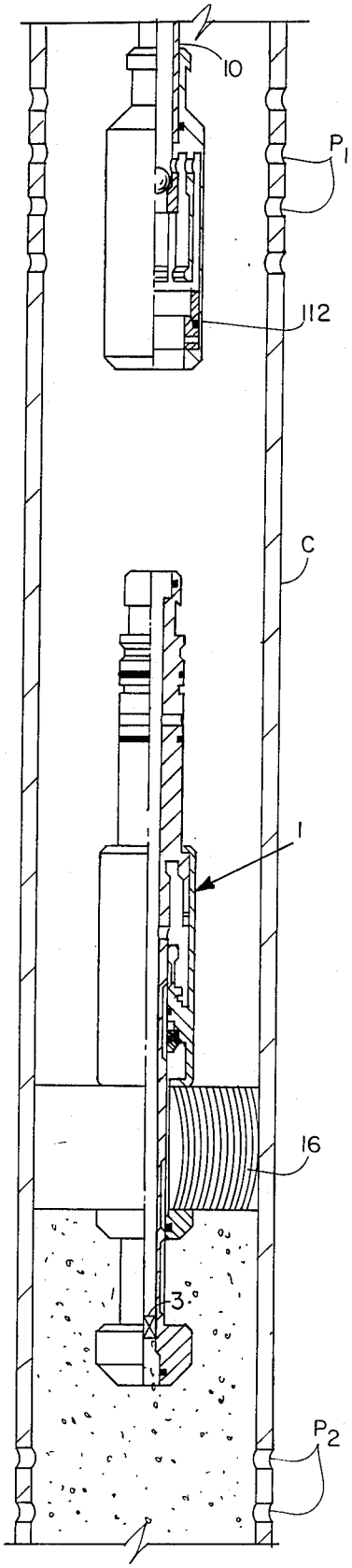
FIG. 5B is a view similar to FIG. 5A but showing the upward removal of the run-in tool after completion of the cementing operation.

Referring now to FIG. 5A, an inflatable tool embodying this invention can be employed to conduct the cementing of a lower formation P2 in a well without interfering with production from upper active formations. Thus, the inflatable tool 1 is positioned above the production formation(s) for which cementing is desired and is inflated in that position to seal against the bore of the casing C. The cementing fluid is then supplied through the coiled tubing 10 and a conventional check valve 3 in tool 1 until the cement approaches the bottom of the inflated packer. The fluid pressure within the coiled tubing 10 may then be increased after dropping a seating ball to actuate the fluid pressure actuated release mechanism in the run-in tool 12, and the coiled tubing 10 and run-in tool 12 may be removed from the well, as shown in FIG. 5B.

Thee are a number of desirable operations that can be conducted within a producing well without removal of a packer or the associated tubing when an inflatable packer having axially spaced, dual inflatable elements is employed. Prior to discussing these new methods of utilization of inflatable packers, it is believed desirable to briefly describe the apparatus for effecting the concurrent inflation and deflation of an inflatable packer having two or more axially spaced, inflatable elements in place of a single inflatable element, as heretofore described.

Referring to FIGS. 6A, 6B and 6C, there is disclosed a body assembly 14' of an inflatable packing tool 2 incorporating two inflatable elements, namely an upper inflatable element 16 and a lower inflatable element 16'. The upper inflatable element 16 and all of the apparatus disposed above the upper inflatable element 16 is substantially identical to that previously described in connection with FIGS. 1A–1F and identified by similar numerals. Thus an inner body sleeve 60 is provided which cooperates with an outer body assemblage comprising threadably connected elements 51, 50 and 62 which define an annular fluid passageway 16*a* supplying pressured fluid received through radial ports 60*a* to the upper expandable element 16 and, at the same time, to the lower expandable element 16'. A shearably secured ball seat sleeve similar to that shown in FIG. 2B is provided in the bottom of the tool to receive a ball and permit fluid pressure to be built up within inner body sleeve 60. The pressured fluid is supplied through the coiled tubing (not shown) and flows through ports 60*a* to enter the annular valving chamber 54 within which the spring biased check valve 56 is slidably and sealably mounted. Below the check valve 56, a delayed inflation valve 58 is shearably secured to body element 62 in a position blocking passageway of the pressured fluid in the downwardly extending passageway 16*a*. These elements function in the same manner as heretofore described.

An upper connecting sub 115 is threadably secured to the sub 62 by internal threads 115*a*. This threaded connection is sealed by O-ring 62*d*. The lower end of the connecting sub 115 is secured by threads 115*b* and sealed by O-ring 115*c* to the upper end of a conventional upper retention assembly 67 which cooperates with the upper inflatable element 16 in conventional fashion to hold the upper end of such upper inflatable element secured.

The lower end of the upper inflatable element 16 cooperates with a conventional retention assemblage 122. Retention assemblage 124 in turn is threadably secured by internal threads 122*a* to a valve chamber sub 69. Valve chamber sub 69 defines an annular internal chamber 69*a* within which a second delayed inflation valve 58 is mounted to delay the application of fluid pressure to the lower expandable element 16' until the pressure reaches a value sufficient to effect the shearing of a shear pin 59 in the same manner as previously described in connection with FIG. 1C.

External threads 69*b* provided on the bottom end of the valve chamber sub 69 provide a threaded connection to a conventional upper retention assemblage 124 which secures the upper end of lower inflatable element 16'. The bottom end of the lower inflatable element 16' is secured by a lower retention assemblage 126 substantially identical to that provided for the upper inflatable element 16. The bottom end of the lowermost retention assemblage 126 is provided with internal threads 126*a* for engagement with a seal sub 18 which is identical to that shown in FIG. 1E and previously described. An O-ring 18*b* seals this threaded connection, and O-rings 18*a* sealingly cooperate with the exterior of inner body sleeve 60.

From the foregoing description, it will be apparent that a common annular fluid passageway 16*a* is provided for both the upper expandable element 16 and the lower expandable element 16'. Subject to the existence of sufficient fluid pressure to cause the opening of the spring biased check valve 56 and the shearing of the shear pins 59 carried by the delayed inflation valves 58, fluid pressure will be concurrently supplied to the interior of the upper inflatable element 16 and the lower inflatable element 16', thus causing both elements to expand outwardly into engagement with the casing wall. While not shown because of the smallness of scale of the drawings, the inner body sleeve 60 is provided with peripherally spaced, longitudinally extending grooves at both its upper and lower ends to effect a bypass of the seal 56*a* provided on the inside of the check valve 56 and the O-rings 18*a* provided on the interior of the seal sub 18 to concurrently effect the deflation of both packing elements 16 and 16' upon the occurrence of upward movement of the inner body sleeve 60 relative to the outer body assemblage.

It will be noted that the packer employing dual inflatable elements is not provided with a pressure equalizing mandrel. Such pressure equalization is no longer required due to the fact that the tool is opened to the well bore above and below and stays equalized, unless an imbalance is caused by the flow of fluid through the tool. This flow of fluid would not be stopped when the tool is retrieved.

Referring now to FIGS. 7A and 7B there is shown an inflatable tool 2 having vertically spaced inflatable elements 16 and 16' which has been run into a well through tubing T, expansion joint E and a packer P and positioned so that both the upper and lower inflatable elements 16 and 16' are respectively disposed in bridging relation to a selected formation, here shown as the formation adjacent perforations P2, for which isolation is required. If the isolated formation is producing an undesired fluid, such as water or gas, the packer version of the inflatable packing tool 2, shown in FIGS. 7A and 7B, is employed, wherein, after setting of the upper and lower inflatinflatable elements 16 and 16', the ball seat sleeve 5 carried in the bore of the inflatable packer is blown out of the bottom of the inflatable packer and fluid communication is established with formations existing below the isolated formations. The dropping of a second, larger ball onto the upwardly facing ball seating surface 31*a* (FIG. 1A) carried in the run-in tool 12 will permit fluid pressure to be applied through the coiled tubing sufficient to effect the disengagement of the run-in tool 12 from the inflatable packing tool 2 thus permitting the coiled tubing 10 and run-in tool 12 to be removed from the well and the selected isolated formation, here shown as adjacent to perforations P2, to remain isolated from the remaining formations, as illustrated in FIGS. 8A and 8B, but with fluid communication maintained between the remaining formations through the open bore of the inflatable packer 2.

Of course, whenever it is desired to terminate the isolation of the particular formation, it is only necessary to run in a wireline tool to engage the fishing neck 44 provided on the top of the uppermost outer body 40 (FIG. 1B) and the application of an upward force by the wireline will effect the deflation of both the upper and lower inflatable elements and permit the removal of the entire tool from the well, in the same manner as described in connection with the modification of FIGS. 1A–1F.

Still another method of utilization of an inflatable packing tool 2 carrying two vertically spaced, inflatable packing elements is to effect the isolation of a leaking packer. Referring now to FIGS. 9A and 9B, the inflatable tool 2 carrying two vertically spaced, inflatable elements 16 and 16' is run into the well through the tubing T and positioned with the upper inflatable element 16 lying within the bore of the packer P or an extension sleeve PE depending from the packer P, and the lower inflatable element 16' lying beneath the packer P and adjacent the bore of the casing C.

When the two inflatable elements 16 and 16' are concurrently inflated, as illustrated in FIGS. 9C and 9D, the upper inflatable element will effectively seal off the bore of the leaking packer P and the lower inflatable element 16' will seal off the annulus between the casing and the body of the inflatable tool 2.

As shown in FIG. 9B, the inflatable tool 2 incorporates the packer version of a ball seat sleeve 5 shearably mounted within the bore of the inflatable tool, hence the fluid pressure is increased to a level sufficient to blow such ball seat sleeve and the cooperating ball down into the well after the inflation of the upper and lower packing elements 16 and 16' has been accomplished.

The dropping or pumping of a second ball B2 to seat on the upwardly facing ball seating surface 31*c* provided in the run-in tool 12 will permit the fluid pressure supplied through the coiled tubing 10 to be increased to a level to effect the release of the run-in tool 12 from the inflated tool 2, permitting such tool to be withdrawn from the well with the coiled tubing 10, as indicated in FIGS. 9C and 9D. Thus, leakage through the leaking packer P is effectively eliminated and the inflatable packer may remain in place for the full extent of its useful life, permitting the well to continue producing without the lengthy interruption that would normally be required to replace the leaking production packer.

Those skilled in the art will recognize that the aforedescribed structural modifications of inflatable tools embodying this invention permit a wide variety of applications of such tools in the chemical treatment, formation isolation, flow control and cementing of formations in producing or injection wells without requiring the removal of the packer and primary tubing string. Additionally, leakage of a packer may be effectively overcome without requiring the removal of such leaking packer. The economic benefits of the methods of this invention are thus readily apparent.

All of the described modifications assumed that the well was cased and the primary tubing string was anchored in the well by a conventional packer. The methods and apparatus of this invention may be employed in uncased wells and with a tubing string supported in the well by means other than a packer.

In all modifications illustrated in the drawings, the disconnection of the run-in tool 12 from inflatable tool 1 was shown as being accomplished by fluid pressure. It should be mentioned that such disconnection can also be accomplished mechanically by an upward pull on the coiled tubing, by inserting a conventional tension disconnect device between the run-in tool 12 and the inflatable tool 1.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a producing subterranean well traversing a plurality of production formations and having a tubing string extending from the well surface to a position above said production formations, the method of isolating and treating at least one of said production formations comprising the steps detachably securing an inflatable packer to the end of a small diameter conduit by a run-in tool having a fluid pressure operated release mechanism;

said inflatable packer having an open central bore and a sleeve defining an upwardly facing ball seating surface shearably secured in said central bore;

running the inflatable packer on said conduit through said tubing string and said packer to a position above a selected production formation;

passing a ball through said coiled tubing to seat on said ball seat;

passing pressurized fluid through said conduit and into the inflatable packer to set the inflatable packer within the casing and isolate said selected production formation from upper formations;

increasing the fluid pressure in the said conduit to shearably force said sleeve and ball downwardly out of the inflated packer; and supplying treatment fluid to said selected formation through said conduit.

2. The method of claim 1 further comprising the steps of:

releasing the inflatable packer from the end of the small diameter conduit by operating said fluid pressure operated release mechanism;

removing the small diameter conduit from the well;

engaging the inflatable packer by wireline to effect the deflation thereof and removal from the well.

3. In a producing subterranean well having a casing traversing a plurality of production formations and perforated to communicate with said formations, a packer sealably set in said casing above said production formations, and a tubing string sealably mounted in said packer and extending to the well surface, the method of isolating and treating at least one of said production formations comprising the steps of:

detachably securing an inflatable packer to the end of coiled tubing by a run-in tool having a fluid pressure operated release mechanism and an upwardly facing ball seating surface;

said inflatable packer having an open central bore and a sleeve defining an upwardly facing ball seating surface shearably secured in said central bore;

running the inflatable packer on said coiled tubing through said production tubing string and said production packer to a position above a selected production formation;

passing a ball through said coiled tubing to seat on said ball seat;

passing pressurized fluid through the coiled tubing and into the inflatable packer to set the inflatable packer within the casing and isolate said selected production formation from upper formations;

increasing the fluid pressure in the coiled tubing to shearably force said sleeve and ball downwardly to open said central bore of the inflated packer; and supplying treatment fluid to said selected formation through said coiled tubing.

4. In a producing subterranean well having a casing traversing a plurality of production formations, one of which produces undesired fluid and others of which produce desired hydrocarbon fluids, and having tubing string suspended in the well and terminating above said production formations; the method of isolating the undesired fluid producing formation comprising the steps of:

assembling two inflatable packers in sufficient axially spaced relationship to straddle said undesired fluid producing formation, said assembled inflatable packers having communicating central bores and inflation passages communicating with said central bores;

detachably securing the upper inflatable packer to the end of a small diameter conduit by a run-in tool having a fluid pressure operated release mechanism;

running the assembled inflatable packers on said conduit through said tubing string to position the two inflatable packers in straddling relationship to said undesired fluid producing formation; and passing pressurized fluid through said conduit to set the inflatable packers within the well and isolate said undesirable fluid producing formation.

5. In a producing subterranean well having a casing traversing a plurality of production formations, one of which produces undesired fluid and others of which produce desired hydrocarbon fluids; a production packer sealably set in said casing above said production formations, and a production tubing string sealably mounted in said production packer, the method of isolating the undesired fluid producing formation comprising the steps of:

assembling two inflatable packers in sufficient axially spaced relationship to straddle said undesired fluid producing formation, said assembled inflatable packers having communicating central bores and inflation passages respectively communicating with said central bores;

detachably securing the upper inflatable packer to the end of coiled tubing by a tubular run-in tool having a fluid pressure operated release mechanism; running the assembled inflatable packers on said conduit through said tubing string to position the two inflatable packers in straddling relationship to said undesired fluid producing formation; and passing pressurized fluid through said conduit to set the inflatable packers within the well and isolate said undesirable fluid producing formation.

6. The method of claim 4 further comprising the steps of:

creating a fluid pressure within the bore of said tubular run-in tool to actuate said fluid pressure operated release mechanism and effect the release of said run-in tool from the upper inflatable packer; and retrieving said conduit and said run-in tool from the well.

7. The method of claim 6 further comprising engaging the upper inflatable packer by wireline to first deflate and then retrieve both deflated packers from the well.

8. The method of claim 4 wherein said lower inflatable packer has a ball seat sleeve shearably secured in the bore thereof and said run-in tool has a larger ball seat formed therein;

said step of passing pressurized fluid to set said inflatable packers comprising first positioning a ball to seat on said ball seat sleeve;

after inflation of said inflatable packers, increasing the fluid pressure in said conduit to force said shearably secured ball seat sleeve downwardly to open said central bore of said lower inflatable packer;

passing a second ball through said conduit to seat on said larger ball seat in said run-in tool; and increasing fluid pressure in said conduit sufficiently to actuate said pressure operated release mechanism, thereby permitting said conduit and run-in tool to be retrieved from the well.

9. In a producing subterranean well having a casing traversing a plurality of production formations, one of which produces undesired fluid, and others of which produce desired hydrocarbon fluids; a production packer sealably set in said casing above said production formation, and a production tubing string sealably mounted in said production packer; the method of isolating the undesired fluid producing formation comprising the steps of:

assembling two inflatable packers in sufficient axially spaced relationship to straddle said undesired fluid producing formation, said assembled inflatable packers having communicating central bores and inflation passages communicating with said central bores;

said lower packer having a ball seat sleeve shearably secured in the lower portion of said central bore;

detachably securing the upper inflatable packer to the end of coiled tubing by a fluid pressure operated release mechanism;

running the assembled inflatable packers on said coiled tubing through said production tubing string and said production packer to position the two inflatable packers in straddling relationship to said undesired fluid producing formation;

passing a ball through said coiled tubing to seat on said ball seat sleeve;

passing pressurized fluid through the coiled tubing to set the inflatable packers within the casing and isolate said undesirable fluid producing formation; and increasing the fluid pressure in said coiled tubing to force said ball seat sleeve downwardly to open said central bore of said lower packer.

10. In a subterranean well having a casing traversing a production formation and perforated to communicate with said production formation, a packer set in said casing above said production formation but subject to leakage, and a tubing string sealably mounted in the bore of said packer and extending to the well surface, the method of preventing fluid leakage past said packer comprising the steps of:

assembling two inflatable packers in axially spaced relationship, said assembled inflatable packers having communicating central bores and inflation passages communicating with said central bores;

detachably securing the upper inflatable packer to the end of a small diameter conduit;

running the assembled inflatable packers on said conduit through said tubing string and said packer to position the lower inflatable packer in the casing below the packer and the upper inflatable packer in the bore of said packer; and passing pressurized fluid through said coiled tubing to inflate said upper inflatable packer into sealing engagement with the bore of said production packer and to inflate said lower packer into sealing engagement with the casing, thereby preventing well fluids leaking past the production packer.

11. The method of claim 10 wherein the detachable securement of the upper inflatable packer to the small diameter conduit is accomplished by a run-in tool having a fluid pressure operated release mechanism and further comprising the step of increasing fluid pressure in said conduit sufficiently to actuate said pressure operated release mechanism, thereby permitting said conduit and run-in tool to be retrieved from the well.

12. The method of claim 11 wherein said lower inflatable packer has a ball seat sleeve shearably secured in the bore thereof and said run-in tool has a larger ball seat formed therein;

said step of passing pressurized fluid to set said inflatable packers comprising first passing a ball through said conduit to seat on said ball seat sleeve;

after inflation of said inflatable packers, increasing the fluid pressure in said conduit to force said shearably secured ball seat sleeve downwardly to open the center bore of said lower inflatable packer;

passing a second ball through said conduit to seat on said larger ball seat in said run-in tool; and increasing fluid pressure in said conduit sufficiently to actuate said pressure operated release mechanism, thereby permitting said conduit and run-in tool to be retrieved from the well.

13. In a subterranean well having a casing traversing a plurality of production formations and perforated to communicate with said production formations, a packer sealably set in said casing, and a tubing string sealably mounted in said packer and extending to the well surface, the method of limiting fluid flow into or out of a selected production formation comprising the steps of:

detachably securing an inflatable packer to the end of a small diameter conduit by a run-in tool having a fluid pressure operated release mechanism;

said inflatable packer having an open central bore and a sleeve defining an upwardly facing ball seating surface shearably secured in said central bore;

running the inflatable packer on said conduit through said tubing string and said packer to a position above a selected production formation;

passing a ball through said conduit to seat on said ball seating surface;

passing pressurized fluid through said conduit and into the inflatable packer to set the inflatable packer within the casing and isolate said selected production formation from upper formations;

increasing the fluid pressure in said conduit to shearably force said sleeve and ball downwardly out of the central bore of the inflated packer, whereby fluid flow into or out of said selected formation passes through said central bore of said inflated packer;

disconnecting said run-in tool from the inflated packer and removing said conduit and run-in tool from the well;

running in a tubular flow controlling tool and detachably connecting same to the inflated packer in the position previously occupied by said run-in tool;

said flow control tool defining a constricted flow passage communicating between said central bore of said inflated packer and the bore of said tubing string, thereby limiting fluid flow into or out of said selected production formation.

14. The method of claim 13 including the step of releasably sealably securing a tubular choke defining said constricted flow passage within the bore of said tubular flow control tool, whereby said tubular choke is removable by wireline and replacable by another choke by wireline to permit variation in flow area of said constricted passage.

15. In an inflatable packer of the type suspended by coiled tubing and insertable through a tubing string for setting within a subterranean well by expansion of an inflatable element, said inflatable packer having a tubular body assembly defining a central bore extending downwardly through substantially the entire length of the inflatable packer, the improvement comprising: radial port means disposed in said tubular body assembly below said inflatable element; an elongated sleeve valve shearably positioned in said tubular body assembly in bridging relationship to said radial port means; said sleeve valve extending upwardly through said tubular housing; tubular connection means for connecting the top end of said tubular housing to said coiled tubing; said tubular connection means surrounding and sealably engaged with the upper end of said sleeve valve and containing fluid pressure responsive means for disconnecting from said tubular body assembly; whereby said coiled tubing and said tubular connection means may be removed from the well after setting said inflatable packer in the well; and said sleeve valve having fishing tool engaging means on its said upper end, whereby said sleeve valve may be engaged by wireline for removal from the well, thereby equalizing fluid pressure above and below said inflatable element.

16. The apparatus of claim 15 wherein said tubular connection means has a radial fluid passage communicating between the bore of said tubular connection means and said fluid pressure responsive means; and a sleeve in said tubular connection means defining an upwardly facing ball seat below said radial fluid passage; said sleeve being sealingly engaged with said upper end of said sleeve valve.

17. The apparatus of claim 15 wherein the bottom end of said tubular housing comprises a tubular circulation housing having radial circulation ports; a cylindrical valve element slidably and sealably mounted in the bore of said circulation housing and having radial passages alignable with said circulation ports in one axial position of said valve element relative to said circulation housing; shearable means securing said cylindrical valve element in said one axial position; means for connecting said sleeve valve in abutting relationship to said valve element; and ball seat means secured to said sleeve valve for receiving a ball valve passed through said coiled tubing, whereby fluid pressure applied through said coiled tubing shifts said cylindrical valve element downwardly from said one position to a second position to close said circulation ports.

18. The apparatus of claim 17 further comprising means for locking said cylindrical valve element in said second position.

19. A run-in tool for running an inflatable packer having a tubular body into a subterranean well on coiled tubing comprising an upper tubular element secured to the bottom end of the coiled tubing; a lower tubular element having its bottom end secured to the top portion of the tubular body of the inflatable packer and its top end inserted in the bottom end of said upper tubular element; a latching collet on one of said tubular elements, a latching surface on the other of said tubular elements cooperating with said latching collet to releasably secure said upper and lower elements together; a sleeve piston slidably and sealably mounted intermediate said upper and lower tubular elements; said sleeve piston retaining said latching collet in engagement with said latching surface in one axial position of said sleeve piston; shearable means for securing said sleeve piston in said one axial position; fluid ports in said upper element communicating between one axial end of said sleeve piston and the bore of said upper tubular element; and a ball valve seat in said upper tubular element for receiving a ball to close the bore of said upper tubular element below said ports, whereby fluid pressure may be applied through said coiled tubing to shift said sleeve piston from said one axial position to release said latching collet from said latching surface and permit retrieval of said upper tubular element, said piston and the ball from the well.

20. In a subterranean well having a casing traversing a plurality of production formations and perforated to communicate with said production formations, a packer sealably set in said casing, and a tubing string sealably mounted in said packer and extending to the well surface, the method of cementing the lower production formations without removal or contamination of the tubing string and packer, comprising the steps of:

detachably securing an inflatable packer to the end of a small diameter conduit by a run-in tool;

said inflatable packer having an open central bore and a sleeve defining an upwardly facing ball seating surface shearably secured in said central bore;

running the inflatable packer on said conduit through said tubing string and said packer to a position above a selected production formation;

passing a ball through said conduit to seat on said ball seating surface;

passing pressurized fluid through said conduit and into the inflatable packer to set the inflatable packer within the casing and isolate said selected production formation from upper formations;

increasing the fluid pressure in said conduit to shearably force said sleeve and ball downwardly out of said central bore of the inflated packer;

supplying cementing fluid to said lower production formation through said conduit; and detaching said run-in tool from said inflated packer for retrieval from the well by said conduit.

21. In a subterranean well having a casing traversing a plurality of production formations and perforated to communicate with said production formations, a packer sealably set in said casing, and a tubing string sealably mounted in said packer and extending to the well surface, the method of cementing the lower production formations without removal or contamination of the tubing string and packer, comprising the steps of:

detachably securing an inflatable packer to the end of a small diameter conduit by a run-in tool having a fluid pressure operated release mechanism and an upwardly facing ball seat;

said inflatable packer having an open central bore and a sleeve defining an upwardly facing ball seating surface shearably secured in said central bore;

running the inflatable packer on said conduit through said tubing string and said packer to a position above a selected production formation;

passing a ball through said conduit to seat on said ball seating surface;

passing pressurized fluid through said conduit and into the inflatable packer to set the inflatable packer within the casing and isolate said selected production formation from upper formations;

increasing the fluid pressure in said conduit to shearably force said sleeve and ball downwardly out of said central bore of the inflated packer;

supplying cementing fluid to said lower production formation through said conduit;

passing a second ball through said conduit on said upwardly facing ball seat; and increasing fluid pressure in said conduit to detach said run-in tool from said inflated packer for retrieval from the well by said conduit.

22. In a subterranean well having a casing traversing a plurality of production formations and perforated to communicate with said production formations, a packer sealably set in said casing, and a tubing string sealably mounted in said packer and extending to the well surface, the method of isolating and treating at least one of said production formations comprising the steps of:

detachably securing a tubular tool having an inflatable packing element to the end of a small diameter conduit by a tubular run-in tool having a fluid pressure operated release mechanism, said tubular tool having a normally open bore;

running the tool, with the inflatable element deflated, on said conduit through said tubing string and said packer to a position above a selected production formation;

passing pressurized fluid through the conduit and into said tool to expand the inflatable element into sealing engagement with the casing; and utilizing said normally open bore of said tool to supply fluid to or remove fluid from said selected formation.

23. The method of claim 22 further comprising the step of temporarily closing said normally open bore of said tool to increase the fluid pressure in said conduit to a level sufficient to expand the inflatable elements.

24. The method of claim 22 wherein chemical treatment fluid is supplied to the selected formation through said conduit.

25. The method of claim 22 wherein cementing fluid is supplied to the selected formation through said conduit.

26. The method of claim 22 further comprising the step of regulating the rate of fluid flow into or out of said selected production formation by replacing said tubular run-in tool with a choke limiting the fluid flow passage area through said tubular tool.

* * * * *